US007201208B2

(12) United States Patent
Pylkki et al.

(10) Patent No.: US 7,201,208 B2
(45) **Date of Patent: *Apr. 10, 2007**

(54) REDUCED VISIBILITY INSECT SCREEN

(75) Inventors: Russell John Pylkki, St. Paul, MN (US); Patrick Jerome Gronlund, Star Prairie Twonship, WI (US); Rodney Kieth Williams, Stacy, MN (US); Kurt E. Heikkila, Marine on the St. Croix, MN (US)

(73) Assignee: Andersen Corporation, Bayport, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/015,040

(22) Filed: Dec. 17, 2004

(65) Prior Publication Data

US 2005/0121153 A1 Jun. 9, 2005

Related U.S. Application Data

(60) Division of application No. 10/823,235, filed on Apr. 13, 2004, which is a continuation of application No. 10/259,221, filed on Sep. 26, 2002, now Pat. No. 6,880,612, which is a continuation-in-part of application No. 10/068,069, filed on Feb. 6, 2002, now Pat. No. 6,763,875.

(51) Int. Cl.
*E06B 9/52* (2006.01)

(52) U.S. Cl. ..... 160/371; 428/336; 442/125

(58) Field of Classification Search ..... 160/371; 139/420 A; 442/181, 189; 245/8; 174/35 MS
See application file for complete search history.

(56) References Cited

U.S. PATENT DOCUMENTS

| | | | |
|---|---|---|---|
| 1,887,646 | A | 11/1932 | Johnston |
| 2,333,618 | A | 11/1943 | Strauss |
| 2,364,404 | A | 12/1944 | Thomas |
| 2,381,542 | A | 8/1945 | Hyatt et al. |
| 2,665,754 | A | 1/1954 | Claussen et al. |
| 3,210,903 | A | 10/1965 | Herolf |

(Continued)

FOREIGN PATENT DOCUMENTS

CA 2443136 A1 8/2003

(Continued)

OTHER PUBLICATIONS

"Insect Screening," 1996, 2 pages, The National Greenhouse Manufacturers Association, Littletn, Colorado, USA.

(Continued)

*Primary Examiner*—Blair M. Johnson
(74) *Attorney, Agent, or Firm*—Womble Carlyle Sandridge & Rice, PLLC

(57) ABSTRACT

A reduced visibility insect screening is described having a transmittance of at least about 0.75 and a reflectance of about 0.04 or less. In an alternative embodiment, an insect screening material includes screen elements having a diameter of about 0.005 inch (0.13 mm), having a bond strength greater than 5500 psi (40 mega Pascals), and having the same transmittance and reflectance limits. In another embodiment of the invention, a screening includes screen elements having a diameter of about 0.005 inch (0.1 mm) or less and a coating on the screen elements having a matte black finish, where the screening has the same transmittance and reflectance limits.

87 Claims, 21 Drawing Sheets

U.S. PATENT DOCUMENTS

| | | | |
|---|---|---|---|
| 3,255,810 | A | 6/1966 | Rowbottam |
| 3,276,942 | A | 10/1966 | Ewing |
| 3,321,003 | A | 5/1967 | Boerner |
| 3,480,069 | A | 11/1969 | Handwerker |
| 3,552,476 | A | 1/1971 | LeTarte |
| 3,632,269 | A | 1/1972 | Doviak et al. |
| 3,760,860 | A | 9/1973 | Kelarakis |
| 3,763,917 | A | 10/1973 | Anitone |
| 3,795,268 | A | 3/1974 | Hendriks |
| 3,927,496 | A | 12/1975 | Kersavage |
| 4,002,188 | A | 1/1977 | Hanks |
| 4,048,360 | A | 9/1977 | Jonda |
| 4,063,998 | A | 12/1977 | Henke |
| 4,083,324 | A | 4/1978 | Krumweide |
| 4,083,325 | A | 4/1978 | Krumweide |
| 4,104,712 | A | 8/1978 | Hafner |
| 4,137,353 | A | 1/1979 | Fariello |
| 4,164,400 | A | 8/1979 | Wald |
| 4,211,816 | A | 7/1980 | Booker et al. |
| 4,231,768 | A | 11/1980 | Seibert et al. |
| 4,234,914 | A | 11/1980 | Boesen |
| 4,239,564 | A | 12/1980 | Krumweide |
| 4,241,123 | A | 12/1980 | Shih |
| 4,247,737 | A | 1/1981 | Johnson et al. |
| 4,253,737 | A | 3/1981 | Thomsen et al. |
| 4,285,748 | A | 8/1981 | Booker et al. |
| 4,298,666 | A | 11/1981 | Taskier |
| 4,399,183 | A | 8/1983 | Withers |
| 4,412,255 | A | 10/1983 | Kuhlman et al. |
| 4,468,702 | A | 8/1984 | Jandrell |
| 4,518,661 | A | 5/1985 | Rippere |
| 4,555,811 | A | 12/1985 | Shimalla |
| 4,562,675 | A | 1/1986 | Baigas, Jr. et al. |
| 4,587,997 | A | 5/1986 | Brooks |
| 4,588,630 | A | 5/1986 | Shimalla |
| 4,592,943 | A | 6/1986 | Cancian et al. |
| 4,609,465 | A | 9/1986 | Miller |
| 4,651,367 | A | 3/1987 | Osher et al. |
| 4,661,376 | A | 4/1987 | Liang |
| 4,686,342 | A | 8/1987 | Collier et al. |
| 4,688,619 | A | 8/1987 | Kessler et al. |
| 4,772,092 | A | 9/1988 | Hofer et al. |
| 4,774,124 | A | 9/1988 | Shimalla et al. |
| 4,778,633 | A | 10/1988 | Kiang et al. |
| 4,819,085 | A | 4/1989 | Liang |
| 4,869,389 | A | 9/1989 | Cerrone, Jr. |
| 4,932,457 | A | 6/1990 | Duncan |
| 4,980,227 | A | 12/1990 | Seikguchi et al. |
| 4,993,187 | A | 2/1991 | Schweiss et al. |
| 5,012,041 | A | 4/1991 | Sims et al. |
| 5,037,455 | A | 8/1991 | Scheineson et al. |
| 5,066,085 | A | 11/1991 | Gimbutus et al. |
| 5,139,076 | A | 8/1992 | Langdon |
| 5,141,046 | A | 8/1992 | Duncan |
| 5,198,287 | A | 3/1993 | Samson et al. |
| 5,211,214 | A | 5/1993 | Shaw |
| 5,299,616 | A | 4/1994 | Sholtz |
| 5,312,467 | A | 5/1994 | Wolfe |
| 5,392,835 | A | 2/1995 | Wildt |
| 5,453,252 | A | 9/1995 | Truett |
| 5,492,551 | A | 2/1996 | Wolfe |
| 5,554,467 | A | 9/1996 | Trokhan et al. |
| 5,563,364 | A | 10/1996 | Alhamad |
| 5,569,455 | A | 10/1996 | Fukui et al. |
| 5,645,936 | A | 7/1997 | Frankfort et al. |
| 5,657,065 | A | 8/1997 | Lin |
| 5,670,234 | A | 9/1997 | Suehr et al. |
| 5,679,232 | A | 10/1997 | Fedor et al. |
| 5,728,632 | A | 3/1998 | Sugie |
| 5,770,144 | A | 6/1998 | James et al. |
| 5,775,400 | A | 7/1998 | Wilkinson |
| 5,776,343 | A | 7/1998 | Cullen et al. |
| 5,785,792 | A | 7/1998 | Locke et al. |
| 5,824,352 | A | 10/1998 | Yang et al. |
| 5,828,494 | A | 10/1998 | Stremple |
| 5,863,440 | A | 1/1999 | Rink et al. |
| 5,895,623 | A | 4/1999 | Trokhan et al. |
| 5,912,077 | A | 6/1999 | Tamaru et al. |
| 5,916,469 | A | 6/1999 | Scoles et al. |
| 5,925,420 | A | 7/1999 | Lee |
| 5,935,475 | A | 8/1999 | Scoles et al. |
| 5,951,727 | A | 9/1999 | Spies et al. |
| 5,977,430 | A | 11/1999 | Roe et al. |
| 5,985,112 | A | 11/1999 | Fischer |
| 5,988,036 | A | 11/1999 | Mangolds et al. |
| 5,996,129 | A | 12/1999 | Lopez |
| 5,997,642 | A | 12/1999 | Solayappan et al. |
| 6,001,118 | A | 12/1999 | Daniel et al. |
| 6,013,063 | A | 1/2000 | Roe et al. |
| 6,022,607 | A | 2/2000 | James et al. |
| 6,024,553 | A | 2/2000 | Shimalla |
| 6,096,371 | A | 8/2000 | Haaland et al. |
| 6,109,331 | A | 8/2000 | Story, Jr. |
| 6,125,905 | A | 10/2000 | Woodside et al. |
| 6,164,361 | A | 12/2000 | Meyer |
| 6,183,872 | B1 | 2/2001 | Tanaka et al. |
| 6,186,215 | B1 | 2/2001 | De Young et al. |
| 6,235,388 | B1 | 5/2001 | Yamamoto et al. |
| 6,240,817 | B1 | 6/2001 | James et al. |
| 6,250,040 | B1 | 6/2001 | Green |
| 6,263,949 | B1 | 7/2001 | Guthrie, Jr. |
| 6,312,640 | B1 | 11/2001 | Shimalla |
| 6,315,547 | B1 | 11/2001 | Shimalla |
| 6,331,223 | B1 | 12/2001 | Wylie et al. |
| 6,341,444 | B1 | 1/2002 | Cina et al. |
| 6,429,750 | B2 | 8/2002 | Curran, Sr. et al. |
| 6,479,143 | B1 | 11/2002 | Tamaru et al. |
| 6,497,946 | B1 | 12/2002 | Kretman et al. |
| 6,716,774 | B2 | 4/2004 | Porter et al. |
| 2001/0042348 | A1 | 11/2001 | Lundahl |
| 2002/0134709 | A1 | 9/2002 | Riddle |
| 2003/0041522 | A1 | 3/2003 | Cauchon |
| 2003/0173042 | A1 | 9/2003 | Haas |
| 2004/0140067 | A1 | 7/2004 | Kelley et al. |
| 2005/0056389 | A1 | 3/2005 | Kelley et al. |

FOREIGN PATENT DOCUMENTS

| | | | |
|---|---|---|---|
| DE | 200 20 267 | U1 | 5/2001 |
| FR | 2272629 | A1 | 12/1975 |
| GB | 2086254 | A | 5/1982 |
| GB | 2161194 | A | 1/1986 |
| GB | 2178765 | A | 2/1987 |
| GB | 2237246 | A | 5/1991 |
| JP | 60-028547 | A2 | 2/1985 |
| JP | 09-195646 | A2 | 7/1997 |
| JP | 2000-27568 | A2 | 1/2000 |
| NL | 9500121 | A | 11/1995 |
| WO | WO 99/49170 | A1 | 9/1999 |
| WO | WO 03/067015 | A1 | 8/2003 |

OTHER PUBLICATIONS

"Insect Screening—Greenhouse Insect Screen Installation Considerations for Greenhouse Operators," 1996, 11 pages, The National Greenhouse Manufacturers Association, Littleton, Colorado, USA.

"Insect Screening," 2002, 2 pages, The National Greenhouse Manufacturers Association, Littleton, Colorado, USA.

Swanson, J. G., "Celebrating the Past, Focusing on the Future," Window & Door, Feb. 2003, 2 pages, National Glass Association, McLean, Virginia, USA.

"Open Weaves," http://www.sefaramerica.com/isa/weaves/weaves2.htm, printed Oct. 22, 2004, 2 pages.

"Vision Screens Components and Sizes," http://www.phantomscreens.com/products/viscomponentsframe.html, printed Oct. 22, 2004, 2 pages.
"Insect Screen," http://www.gothicarchgreenhouses.com/insect_screens.htm, 2 pgs., printed Dec. 10, 2004.
Screen Technology Group, Inc., Bolting Cloth, Apr. 26, 1998.
"Aluminum Insect Screen Cloth", http://www.wire-cloth.com/aluminum-screens.htm, 2 pgs. (Last Revised Jul. 11, 2002).
"Aluminum Insect Screening", http://phifer.com/alumsc.htm, 1 pg. (Printed Jul. 14, 2002).
"Basic Wire Cloth and Wire Mesh Weaving Methods", http://www.wire-cloth.com/weaves.htm 1 pg. (Last Revised Jul. 11, 2002).
"Bronze Insect Screens", http://www.wire-cloth.com/bronze-screens.htm, 1 pg. (Last Revised Jul. 11, 2002).
"Comparative Gauge/Decimal Wire Diameters", http://wire-cloth.com/reference/gauge/htm, 3 pgs. (Last Revised Jan. 3, 2002).
"Detailed Product Specifications for Woven Wire Cloth and Wire Mesh are Illustrated in the Various Product Group Tables", http://www.wire-cloth.com/products.htm, 2 pgs. (Last Revised Jul. 11, 2002).
"Fiberglass Insect Screening", http://www.phifer.com/fiber.htm, 1 pg. (Printed Jul. 28, 2002).
"Fiberglass Insect Screening", http://www.rjreid.co.nz/screen.html, 1 pg. (Printed Jul. 28, 2002).
"Fine Mesh Wire Cloth", http://wire-cloth.com/fine-mesh.htm, 2 pgs. (Last Revised Jul. 11, 2002).
"Galvanized Steel Insect Mesh", http://www.wire-cloth.com/galvanized-screens.htm, 1 pg. (Last Revised Jul. 11, 2002).
"Insect Screening Mesh", http://www.lockerwire.co.uk/Insect.htm, 1 pg. (Printed Jul. 28, 2002).
"Light Transmitting Fabric", http://www.rjreid.co.nz/ltfab.html, 1 pg. (Printed Jul. 28, 2002).
"Market Grade Wire Cloth", http://www.wire-cloth.com/market-cloth.htm, 2 pgs. (Last Revised Jul. 11, 2002).
"Mill Grade Wire Cloth", http://www.wire-cloth.com/mill-cloth.htm, 2 pgs. (Last Revised Jul. 11, 2002).
"Specialty Screen Products", http://www.hanoverwire.com/hscreen.htm, 2 pgs. (Printed Jul. 14, 2002).
"Stanless Steel Insect Screens", http://www.wire-cloth.com/stainless-screens.htm, 1 pg. (Last Revised Jul. 11, 2002).
"Tensile Bolting Cloth", http://www.wire-cloth.com/bolting-cloth.htm, 2 pgs. (Last Revised Jul. 11, 2002).
"Technical Information [High Transparency Wire Mesh]", http://www.twpinc.com/high-trans.html, 2 pgs. (Printed Jul. 28, 2002).
"Technical Information [Insect Screen]", http://www.twpinc.com/insect.html, 2 pgs. (Printed Jul. 28, 2002).
"Technical Information [Welded Stainless Mesh]", *TWP Inc.*, 2831 Tenth Street, Berkeley, CA 94710, http://www.twpinc.com/welded.html, 2 pgs. (Printed Feb. 4, 2003).
"Toyota Wire Cloth", *Toyota Tsusho America, Inc.*, http://ttaiwirecloth.com/screen-printing.htm, 2 pgs. (Last Modified Jul. 16, 2002).
"Toyota Wire Cloth—Top Quality Screen Printing Cloth", *Toyota Tsusho America, Inc.*, http://ttaiwirecloth.com/screen-print-cloth.htm, 3 pgs. (Last Modified Jul. 2, 2002).
The Ludlow-Saylor Wire Company, Manufacturers of The Perfect Double Crimped Wire Cloth and Rex-Tang Screen for Mining and All Other Purposes, Jul. 14, 1938, p. 14, 15 and 61, Catalogue No. 46, Saint Louis, Mo., U.S.A.
The Ludlow-Saylor Wire Company, Manufacturers of The Perfect Double Crimped Wire Cloth and Rex-Tang Screen for All Purposes, Aug. 1, 1924, p. 116-117, Catalogue No. 47, Saint Louis, Mo., U.S.A.
Buffalo Wire Works Company Incorporated (Formerly Scheller's Sons), Jan. 8, 1916, p. 47, 49, and 62; Catalog No. 8, Buffalo, N.Y., U.S.A.
The 1958 Wire Industry Encyclopaedic Handbook, A Comprehensive Reference Book for the Wire-Drawing and Wire Fabricating Industries, May 2, 1958, p. 1, 2, 418-421, 438, and 439. The Wire Industry Limited, London, England.
Laramore, L., "Introduction to Photographic Principles," May 1965, 202-205, Dover Publications, New York, NY USA.
Woodson, W. E., et al., "Human Factors Design Handbook" 1992, 322-343, 352-412, 654-674, 2nd Ed.,McGraw Hill, Inc., USA.
Hecht, E., "Optics," 2002, 215-217, pp. 254-255, 268-269, 393-396, 441, 443-485, 490-501, 507-509, 550-554, 560-573, 606-619 4th ed., Addison Wesly, San Francisco, CA, USA.
Majumder, A., "ICS 280: Visual Perception," http://www.ics.uci.edu/~majumder/docs/spatialvision.pdf, Feb. 4, 2004, 13 pages, University of California at Irvine, Irvine, CA, USA.
Nafziger, J., "Structure of the Retina," Vision Lecture 2004, Unversity of Arizona, http://www.optics.arizona.edu/Nofziger/OPTI%20200/Lecture%2029/200VisionLecture%201%20JMP.pdf, pp. 1-30.
Clark, R. N., "Optimum Magnified Visual Angle Visual Astronomy of the Deep Sky," http://www.clarkvision.com/visastro/omval, last modified Mar. 24, 2002, 12 pages.
Green, M., "Determining Visibility," Visual Expert Human Factors, http://www.visualexpert.com, printed Nov. 23, 2004, 4 pages.
Kalloniatis, M., et al., "Visual Acuity," Webvision The Organization of the Retina and Visual System, John Morgan Eye Center, The University of Utah, http://webvision.med.utah.edu/index.html, Last updated Aug. 2003, Part IX, 15 pages.
Green, M., "Inattentional Blindness' & Conspicuity," Visual Expert Human Factors, http://www.visualexpert.com, printed Nov. 23, 2004, 6 pages.
Blackwell, H. R., "Contrast Thresholds of the Human Eye," Journal of the Optical Society of America, Nov. 1946, 624-643, vol. 36, No. 11.
Ferwerda, J. A., "Fundamentals of Spatial Vision," 1998, 1-15, Program of Computer Graphics, Cornell University, New York, USA.
Robison, G. T., "Powder Coating Ups Quality of Window Screen," Products Finishing, Sep. 1976, 42-47, Gardner Publications, Inc., Cincinnati, Ohio, USA.
Coren, S., et al., "Sensation and Perception," 2004, pp. 1-12, 43-115, 216-231, 472, 6th Ed., John Wiley & Sons, Inc., Hoboken, New Jersey, USA.
Pogue, B. et al., "Absorbance of Opaque Microstructures in Optically Diffuse Media," Applied Optics, Sep. 1, 2001, pp. 4616-4621, vol. 40, No. 25, Optical Society of America, USA.
http://www.uniquewire.com/metals/alum.cfm, printed Jun. 10, 2005 (web page copyright 2004).
http://www.wovenwire.com/screendata/18x14-009-aluminum.htm, printed Jun. 10, 2005.
http://web.archive.org/web/20010814082330/www.tjwiremesh.com/6-4.htm, printed Jun. 10, 2005.
http://www.tjwiremesh.com/wire_mesh/woven_wire_mesh/window_screen-insect_screen.htm, printed Jun. 10, 2005 (web page copyright 1978-2004).
http://www.wirenetting.com/stainless-steel-wire-mesh/wire-mesh/window-screening.htm, printed Jun. 10, 2005 (web page copyright 2004).
http://www.metal-wire-mesh.com/wire-mesh/insect-screen-netting.htm, printed Jun. 10, 2005 (web page copyright 2004).
http://www.wiremeshbest.cn/en/chuangasha.htm, printed Jun. 10, 2005.
http://www.siemesh.com/wiremesh/screen.htm, printed Jun. 10, 2005.
http://www.haixing-wiremesh.com/english/window%20screening.htm, printed Jun. 10, 2005 (web page copyright 2002.
http://rql-wiremesh.com/wire-mesh-wire-mesh/qyjj-e.htm, printed Jun. 10, 2005 (web page copyright 2002).
http://www.hmc-wiremesh.com/wire-mesh-wire-cloth/window-screening.htm, printed Jun. 10, 2005.
http://www.yaohua-wiremesh.com/metal-wire-mesh/insect-screen.htm, printed Jun. 10, 2005.
http://www.anyangwiremesh.com/stainless-steel-wire-mesh/iron-wire-mesh.htm, printed Jun. 10, 2005.
http://www.yongshengwiremesh.com/welded-wire-mesh/welded-wire-mesh-9.htm, printed Jun. 10, 2005 (web page copyright 2004).
http://www.fzwiremesh.com/wiremesh/wiremeshscreen.htm, printed Jun. 10, 2005.

http://www.jiulong-wiremesh.com/hardware-wire-cloth/square-wire-mesh/mosquito-wire-netting.htm, printed Jun. 10, 2005 (web page copyright 1997-2003).
http://www.wiremeshworld.com/wiremesh.mosquitonet.htm, printed Jun. 10, 2005.
http://www.fivestar-netting.com/weldedwiremesh/windowscreen-netting.htm, printed Jun. 10, 2005 (web page copyright 1997-2003).
http://www.uniquewire.com/metals/fcmetals_index.cfm, printed Jun. 10, 2005 (web page copyright 2004).
http://www.china-wirenetting.com, printed Jun. 13, 2005.
http://www.wiremesh-china.com/wire-mesh/insect-screening.htm, printed Jun. 10, 2005 (web page copyright 2005).
http://www.thescreenplace.com, printed Jun. 13, 2005 (web page copyright 1998).
http://www.thescreenplace.com/Merchant2/merchant.mvc?Screen=CTGY&Store_Code=TSP&Category_Code=G200X000, printed Jun. 13, 2005 (web page copyright 1998, last edited Jan. 26, 2004).
http://web.archive.org/web/20010408045903/wirenetting.com/mesh/wire-netting.htm, printed Jun. 13, 2005.
http://web.archive.org/web/20010412214536/www.wiremeshes.com.cn/screen.htm, printed Jun. 13, 2005.
http://www.wiremeshes.com/cn/aboutus.htm, printed Jun. 13, 2005 (web page copyright 1998).
http://web.archive.org/web/20000614223422/www.china-wirenetting.com/wiremesh/wirenetting.htm, printed Jun. 13, 2005.
http://web.archive.org/web/20010627213348/www.uniquewire.com/spec-bod.html, printed Jun. 13, 2005.
http://web.archive.org/web/20010220163041/www.uniquewire.com/stock.html, printed Jun. 13, 2005.
http://web.archive.org/web20010221025321/www.uniquewire.com/spec.html, printed Jun. 13, 2005.
http://web.archive.org/web20010718154931/www.uniquewire.com/wire-spec.html, printed Jun. 13, 2005, copyright 1999.
California Fine Wire Company, Wire Gauge Chart, http://www.calfinewire.com/wirech.htm, 2 pages, printed May 31, 2005.
Anhua Hardware & Meat Product Co., LTD, Products, http://web.archive.org/web/20000531002252/www.china-wirenetting.com/default.htm, 23 pages, printed May 31, 2005 (Last Revised Jan. 18, 1999).
ASTM Serial Designation B50-27T, Tentative Specifications for Non-Ferrous Insect Screen Cloth, Oct. 1928, 4 pgs.
British Standard Specification No. 481-1933, Woven Wire and Perforated Plate Sieves and Screens for Industrial Purposes, 1933, 7 pgs.
Buffalo Wire Works Co., Catalog No. 8, 1916, 66 pgs.
Ezdorf, R., Prevention of Malaria, United States Public Health Service, 1916, 9 pgs.
Fisher Scientific Company, Modern Laboratory Appliances, Catalog 59, 1958, pp. 159-161.
Glenco Manufacturing Company, Products and Services Scales: Hand-Held thru Signage, 1998, 33 pgs.
Hogentogler & Co., Inc., Sieves, printed Jul. 20, 2005, available at http://www.hogentogler.com/sieves, 4 pgs.
Hornbostel, C., Construction Materials Types, Uses and Applications, Second Ed., 1991, 17 pgs.
ISO 2194, Second Ed., Industrial Screens—Woven Wire Cloth, Perforated Plate and Electroformed Sheet—Designation and Nominal Sizes of Openings, 1991, 8 pgs.
ISO 2591-1, First Ed., Test Sieving—Part 1: Methods Using Test Sieves of Woven Wire Cloth and Perforated Metal Plaste, 1988, 17 pgs.
ISO 3310-1, Third Ed., Test Sieves—Technical Requirements and Testing—Part 1: Test Sieves of Metal Wire Cloth, 1990, 11 pgs.
ISO 4782, Second Ed., Metal Wire for Industrial Wire Screens and Woven Wire Cloth, 1987, 7 pgs.
ISO 4783-1, Second Ed., Industrial Wire Screens and Woven Wire Cloth—Guide to the Choice of Aperture Size and Wire Diameter Combinations—Part 1: Generalities, 1989, 13 pgs.
ISO 4783-2, Second Ed., Industrial Wire Screens and Woven Wire Cloth—Guide to the Choice of Aperture Size and Wire Diameter Combinations—Part 2: Preferred Combinations for Woven Wire Cloth, 1989, 10 pgs.
ISO 4783/3, First Ed., Industrial Wire Screens and Woven Wire Cloth—Guide to the Choice ofAperture Size and Wire Diameter Combinations—Part 3: Preferred Combinations for Pre-Crimped or Pressure-Welded Wire Screens, 1981, 8 pgs.
ISO 565, Third Ed., Test Sieves—Metal Wire Cloth, Perforated Metal Plate and Electroformed Sheet—Nominal Sizes of Openings, 1990, 7 pgs.
ISO 9044, First Ed., Industrial Woven Wire Cloth—Technical Requirements and Testing, 1990, 13 pgs.
Mohr, J., et al., Fiberglass, 1978, 18 pgs., Van Nostrand Reinhold Co.
SAE Aerospace, SAE AIR888, Rev. B., Aerospace Information Report, Fine Wire Mesh for Filter Elements, 1997, 18 pgs.
U.S. Federal Specification, FSC 5335, A-A-1036 Cancellation, Wire Fabric (Insect Screening), Jan. 10, 1994, 1 pg.
U.S. Federal Specification, FSC 5335, A-A-1036B, Wire Fabric (Insert Screening), Jan. 12, 1987, 4 pgs.
U.S. Federal Specification, FSC 5335, RR-S-141a(2), Screening, Wire, Insect, Jul. 22, 1959, 2 pgs.
U.S. Federal Specification, FSC 5335, RR-W-365A Interim Amendment 1 Notice of Cancellation, Wire Fabric (Insect Screening), May 6, 1999, 1 pg.
U.S. Federal Specification, FSC 5335, RR-W-365A Interim Amendment 1, Wire Fabric (Insect Screening), Jan. 29, 1986, 1 pg.
U.S. Federal Specification, FSC 5335, RR-W-365A, Wire Fabric (Insect Screening), Sep. 5, 1980, 11 pgs.
United State District Court, District of Minnesota, Civil Action No. 05-824 JMR/FLN, *Andersen Corporation* v. *Pella Corporation and W.L. Gore & Associates, Inc.*, Expert Report of Bruce H. Stoner, Jr., May 10, 2006, 27 pgs.

FIG. 1
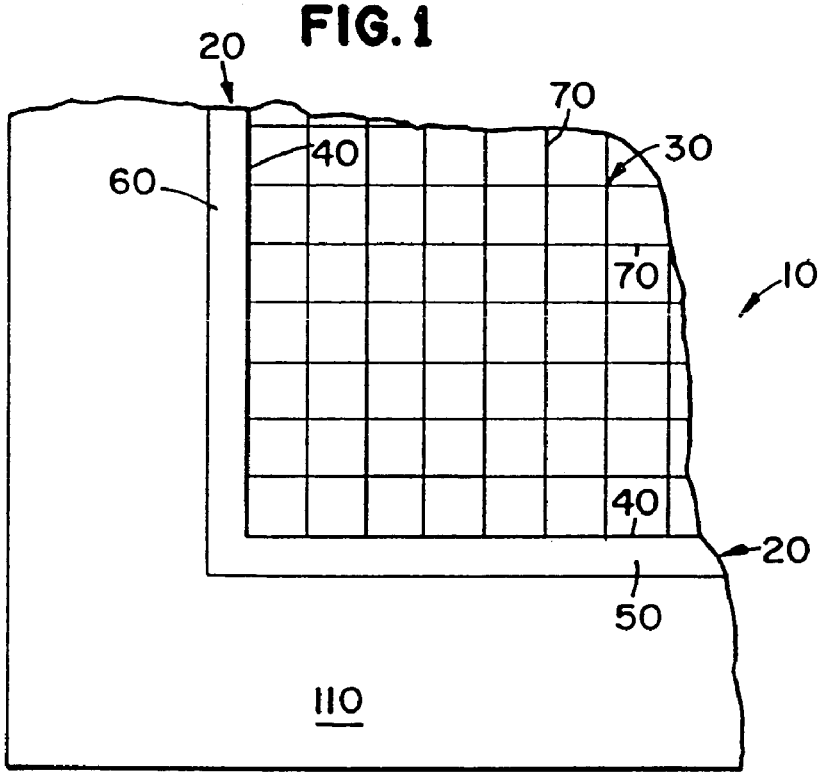
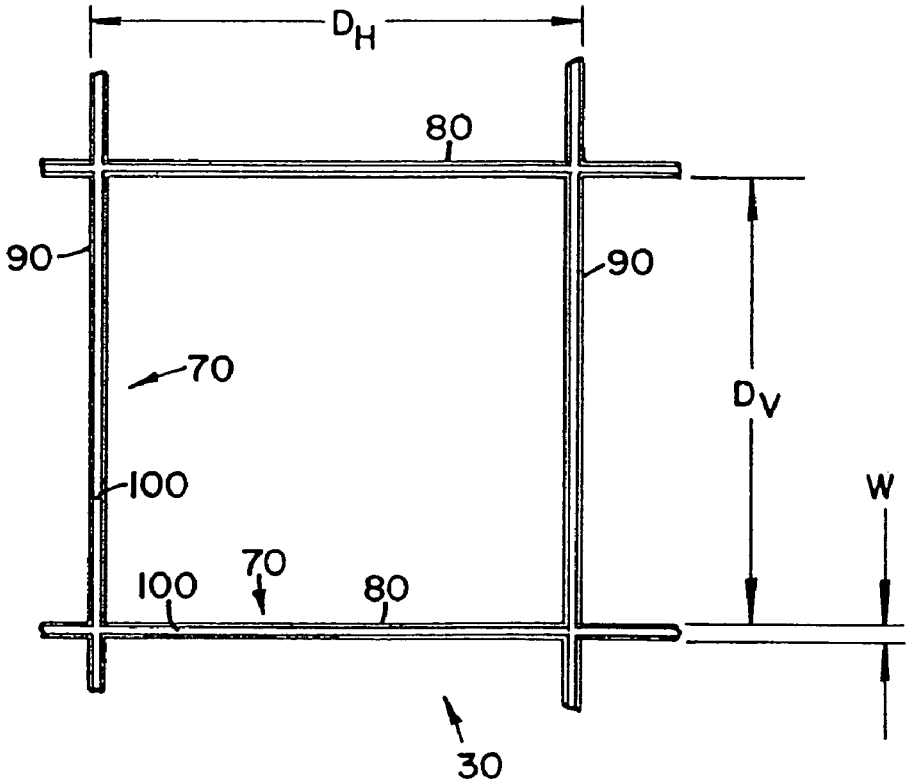
FIG. 2

REDUCED VISIBILITY INSECT SCREEN

CROSS REFERENCE TO RELATED APPLICATIONS

This application is a divisional of co-pending U.S. patent application Ser. No. 10/823,235, filed Apr. 13, 2004, which is a continuation of U.S. patent application Ser. No. 10/259,221, filed Sep. 26, 2002 now U.S. Pat. No. 6,880,612, which is a continuation in part of U.S. patent application Ser. No. 10/068,069, filed Feb. 6, 2002, entitled "REDUCED VISIBLITY INSECT SCREEN," (now U.S. Pat. No. 6,763,875), the contents of which are incorporated herein by reference as if fully stated in entirety.

FIELD OF THE INVENTION

The invention relates to insect screens such as, for example, for windows and doors, that are less visible than conventional insect screens. A screen or screening is a mesh of thin linear elements that permit ventilation but excludes insect pests. To the ordinary observer, the screens are less visible in the sense that the interference to observing a scene either on the exterior or the interior of the screen is substantially reduced.

BACKGROUND OF THE INVENTION

Insect screens are installed on windows and doors in homes to promote ventilation while excluding insects. Insect screens are, however, widely regarded as unattractive. From the inside of a window, some screens obstruct or at least distract from the view to the outside. From the outside, many people believe that screens detract from the overall appearance of a home or building. Homebuilders and realtors frequently remove screens from windows when selling homes because of the improved appearance of the home from the outside. Homeowners frequently remove screens from windows that are not frequently opened to improve the view from the inside and the appearance of the window.

A wide variety of insect screen materials and geometries are available in the prior art. Fiberglass, metallic and synthetic polymer screens are known. These screens suffer from reduced visual appeal due to relatively low light transmission, high reflection or both. Standard residential insect screens include a mesh with horizontal and vertical elements. The most common insect screens have about 18 elements per inch in one direction and 16 elements per inch the other direction, often expressed as being a 18×16 mesh. Some standard screens have a 18×14 mesh. The typical opening size is about 0.040 inch by 0.050 inch. Screens designed to exclude gnats and other very small insects usually include screen elements in a 20×20 mesh. The most common materials for the screen elements are aluminum and vinyl-coated fiberglass. Stainless steel, bronze and copper are also used for insect screen elements. Typical element diameters for insect screens are 0.011 inch for aluminum, bronze and some stainless steel offerings and 0.009 inch for galvanized steel and stainless steel.

Some products on the market advertise a black or charcoal colored screen mesh that is allegedly less visible from the inside of a house. Color coating changes and material changes have made some incremental improvements in the visual appeal of screening to the average observer, but most observers continue to object to the darkening effect that current insect screening causes in observing screens from inside and outside.

SUMMARY OF THE INVENTION

We have found unique features for the elements used to form insect screening that maximize transmission and minimize reflection resulting in reduced visibility of the screening and enhanced viewing through it. The awareness of the insect screen is substantially reduced while the ability to observe details of the viewed scene is greatly enhanced.

A reduced visibility insect screening is described where the transmittance of the screening is at least about 0.75 and the reflectance of the screening is about 0.04 or less.

In an alternative embodiment, an insect screening material includes screen elements having a diameter of about 0.005 inch (0.13 mm) or less. The screen elements have a tensile strength of at least about 5500 psi (40 mega Pascals). Again, the transmittance of the screening is at least about 0.75 and the reflectance of the screening is about 0.04 or less.

In another embodiment of the invention, a screening is described including screen elements having a diameter of about 0.005 inch (0.1 mm) or less and a coating on the screen elements-having a matte black finish. The transmittance of the screening is at least about 0.75 and the reflectance of the screening is about 0.04 or less.

In further alternative embodiments, the transmittance of the screening is at least about 0.80 or the reflectance of the screening is about 0.03 or less, or 0.02 or less. The screening may have an open area of at least about 75%, or at least about 80%. The screening may define mesh openings having a largest dimension not greater than about 0.060 inch (1.5 mm).

The screen elements may have a diameter less than about 0.005 inch (0.1 mm), and may have a tensile strength greater than about 5500 psi (40 mega Pascals). The screen elements may be made of a metal such as steel, stainless steel, aluminum and aluminum alloy, or a polymer such as polyethylene, polyester and nylon. Alternatively, the screen elements may be made of an ultra high molecular weight polyethylene or an amide such as polyamide, polyaramid and aramid.

In one embodiment, the screen elements include a coating, specifically a black matte coating such as electroplated black zinc. In one embodiment the screen elements are made of stainless steel with an electroplated black zinc coating.

BRIEF DESCRIPTION OF THE DRAWING

The invention may be more completely understood by considering the detailed description of various embodiments of the invention that follows in connection with the accompanying drawings.

FIG. 1 is a fragmentary view of an insect screen in accordance with the invention.

FIG. 2 is a fragmentary view of a portion of the insect screen shown in FIG. 1.

DETAILED DESCRIPTION OF THE PREFERRED EMBODIMENT

Figure 3:
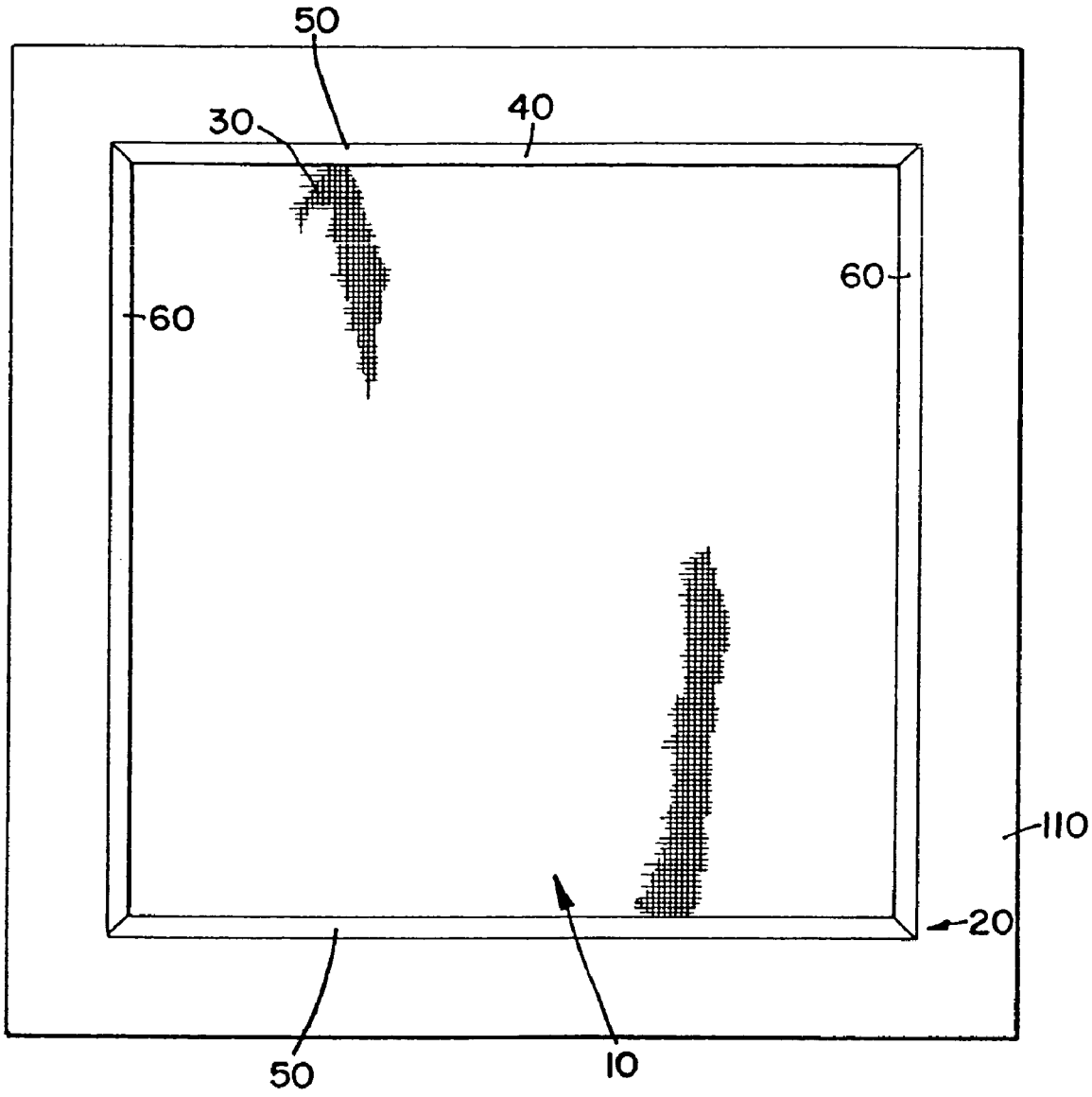
FIG. 3 is a perspective view of the insect screen shown in fragmentary view in FIG. 1.

We have found unique features for insect screening of the invention. We have found that by reducing the size of and selecting proper color and texture for the elements used in the screening, reflection and transmission are controlled such that the visibility of the screening is markedly reduced. The insect screening of the invention maintains comparable mechanical properties when compared to prior art insect screening, but is substantially improved in visual appearance. The insect screening of the invention can be used in the manufacture of original screens and can be used in replacement screens for windows, doors, patio doors, vehicles and many other structures where screening is used. The insect screening of the invention can be combined with metal frames, wooden frames or composite frames and can be joined to fenestration units with a variety of joinery techniques including adhesives, mechanical fasteners such as staples or tacks, splines, binding the screening material into recesses in the screen member frame or other common screen joining technology. When properly installed in conventional windows and doors, the ordinary observer viewing from the interior or the exterior through the insect screening of the invention has a substantially reduced awareness of the screening and a substantially improved ability to observe the scene on the other side of the screen.

We have found that the combination of reduced element size in the screening and coating on the screen elements combine to provide the improved visual properties of the insect screening of the invention. The selected materials disclosed for the screening of the invention are not limiting. Many different materials can satisfy the requirements of the invention.

Screen Within Frame and on Fenestration Unit

FIG. 1 is a fragmentary drawing of a portion of an insect screen 10 in accordance with the present invention. The insect screen 10 consists of a frame 20 including a frame perimeter 40 defining a frame opening. An insect screening 30 fills the opening defined by the frame perimeter 40. The frame 20 supports the screening 30 on all sides of the screening 30. The frame 20 is preferably sufficiently rigid to support the screening tautly and to allow handling when the screen 10 is placed in or removed from a window or door unit.

FIG. 2 is a fragmentary view of a portion of the insect screening shown in FIG. 1. The spaces between screen elements 70 define openings or holes in the screening 30. In a preferred embodiment, the screen elements 70 include horizontal elements 80 and vertical elements 90. Preferably, the horizontal and vertical elements 80, 90 are constructed and arranged to form a mesh where a horizontal metal element intersects a vertical metal element perpendicularly. The intersecting horizontal and vertical metal elements 80, 90 may be woven together. Alternatively, the intersecting horizontal and vertical metal elements 80, 90 may be fused together although they may or may not be woven.

FIG. 3 is a perspective view of the insect screen shown in FIG. 1 positioned in a fenestration unit 110. The frame 20 includes two pairs of opposed frame members. A first pair of opposed frame members 50 is oriented along a horizontal frame axis. A second pair of opposed frame members 60 is oriented along a vertical frame axis. The four frame members 50, 60 form a square or rectangle shape. However, the frame may be any shape.

Goal of Making Screen Less Visible

When light interacts with a material, many things happen that are important to the visibility of insect screening. The visibility of screening can be influenced by light transmission, reflection, scattering and variable spectral response resulting from element dimensions, element coatings, and the dimensions of the mesh openings. In order to reduce the visibility of the screening, the transmittance is maximized, the reflectance is minimized, the remaining reflection is made as diffuse as possible, and any spectral reflectance is made as flat or colorless as possible. To accomplish this, it is beneficial to use screen elements with the smallest dimensions possible while still meeting strength requirements. Maximizing the dimensions of the grid openings will decrease visibility, but the dimensions of the grid openings are also chosen to achieve the desired insect exclusion and strength qualities.

In measuring to what degree an insect screening has achieved reduced visibility, the inventors have found that transmittance and reflectance are the most important factors for visibility of a screen from the exterior of a home. Because the sun is a much stronger light source than interior lighting, visibility of the screen from the exterior of the home is more difficult to reduce than visibility from the interior, as discussed further herein. Also, in double hung windows, the presence of an insect screen on the bottom half of the window contrasts with bare sash on the top half of the window to make the screening stand out.

Figure 4:
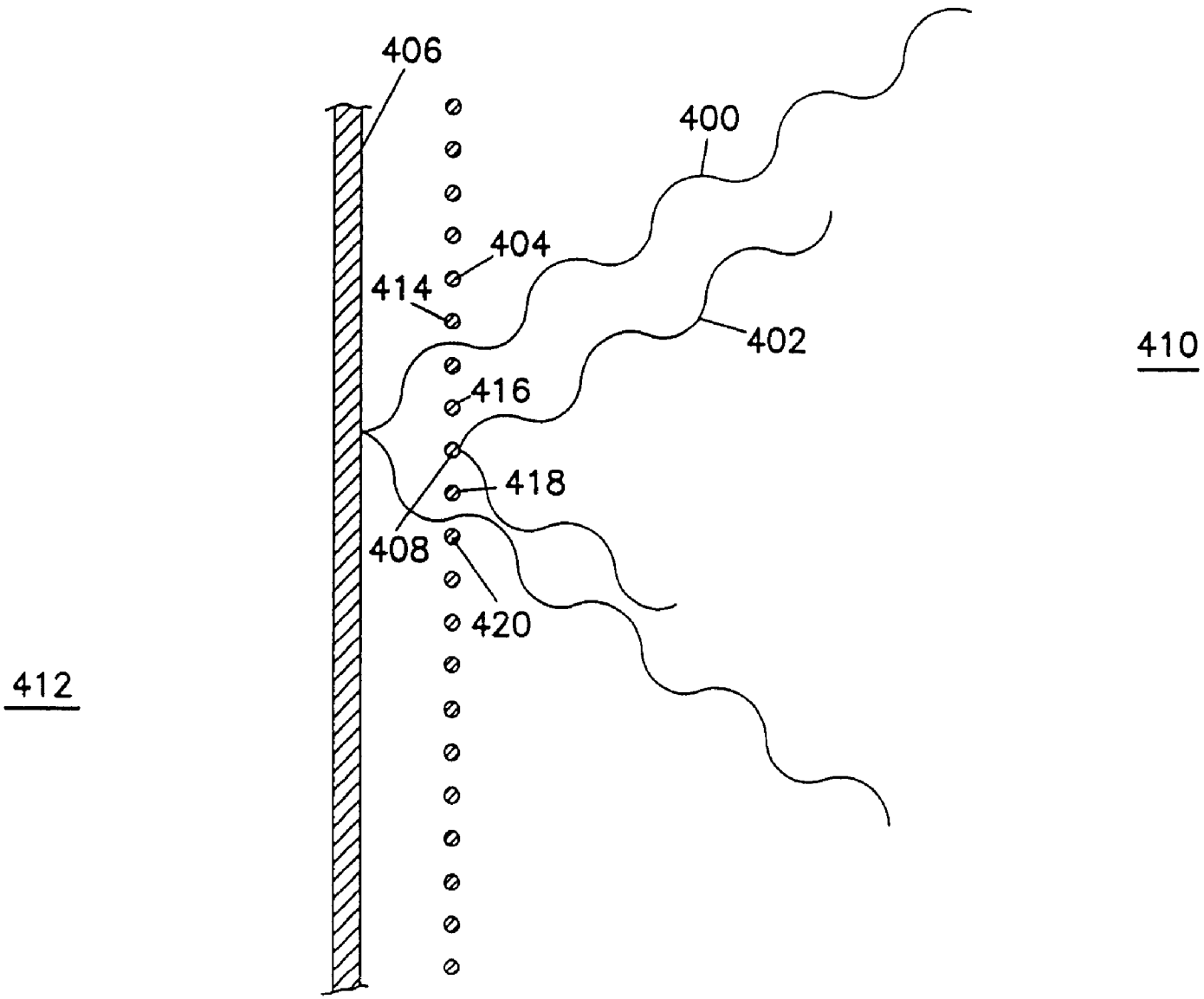
FIG. 4 is a diagram illustrating light paths in reflection from a window unit with a screen.

FIG. 4 shows light paths for one typical viewing situation involving an observer outside a building looking at a screen and window. FIG. 4 shows a cross sectional view of screen 404 and glass 406 in the window. The window separates an exterior viewing location 410 from an interior scene 412, where the screen 404 is on the exterior side of the glass 406. Screen units are commonly positioned on the exterior of the glass, for example, in double-hung windows, sliding windows and sliding doors. Screening 404 is comprised of many elements, including elements 408, 414, 416, 418, and 420. FIG. 4 generally illustrates the path of light ray 400 and light ray 402 as they interact with screen 404 and glass 406. Light rays 402 and 404 are from the sun, which typically dominates the effects of any interior lights during a sunny day. The paths of light ray 400 and light ray 402 depict the ways in which reflectance and transmission affect the visibility of a screen for an outside observer of an exterior screen.

For example, light 402 travels toward glass 406 and reflects off element 408 in a direction away from glass 406. Reflectance is the ratio of light that is reflected by an object compared to the total amount of light that is incident on the object. Solid, non-incandescent objects are generally viewed in reflection. (It is also possible to view an object in an aperture mode where it is visible due to its contrast with a light source from behind it. A smaller screen element size decreases the visibility of a screen viewed in the aperture mode.) Accordingly, objects generally appear less visible if they reflect lower amounts of light. A perfectly reflecting surface would have a quantity of 1 for reflectance, while a perfectly absorbing surface would have a quantity of 0 for reflectance.

Another quantity that affects the visibility of screening is transmittance. When looking through screening, the viewer sees light emanating from or reflected from objects on the other side of the screening. As transmittance of the screening decreases, the viewer sees less light from the objects on the other side of the screening, and the presence of the screening becomes more apparent. Transmittance is defined as the ratio of light transmitted through a body relative to the total amount of light incident on the body. A value of 0 for transmittance would correspond to an object which light cannot penetrate. A value of 1 for transmittance would correspond to a perfectly transparent object. In the case of a window in a home viewed through an exterior insect screen by an outside observer, the light seen has traveled through the screen twice, as shown in FIG. 4. For example, the light 400 travels away from the viewer and through the screen 404. Next, the light is reflected off the window 406 and travels back through the screen 404 toward the outside viewer's eye.

Reducing the visibility of an exterior screen to an outside viewer is considered the most difficult because the intensity of sunlight is so much greater than lights within a building. If the visibility of an exterior screen for an exterior viewer is minimized, the screen will also be less visible for an inside viewer of an exterior screen, and for an inside and outside viewer of an interior screen. However, another important optical feature for invisibility of a screen to an inside viewer is a small element size, as will be further discussed. If the reflectance is minimized, the transmittance is maximized, and the screen element diameter is sufficiently small, the screening will be much less perceptible to inside viewers than conventional screens.

To achieve an insect screen that has reduced visibility, it is desirable to design insect screens with a low reflectance and high transmittance. Material choices and characteristics like color and texture can reduce reflectance. For example, dark matte colors reflect less light than light glossy colors or shiny surfaces. Reducing the cross-sectional area of the material and increasing the distance between the screen elements can increase transmittance. However, material that is too thin may not be strong enough to function properly in a typical dwelling. Similarly, insects may be able to pass through the screen if the distance between the elements is too large. Therefore, it is desirable to obtain a combination of strength, optical and mechanical characteristics within functional limits to achieve a screen with reduced visibility.

Inside and Outside Viewers

Figure 5:
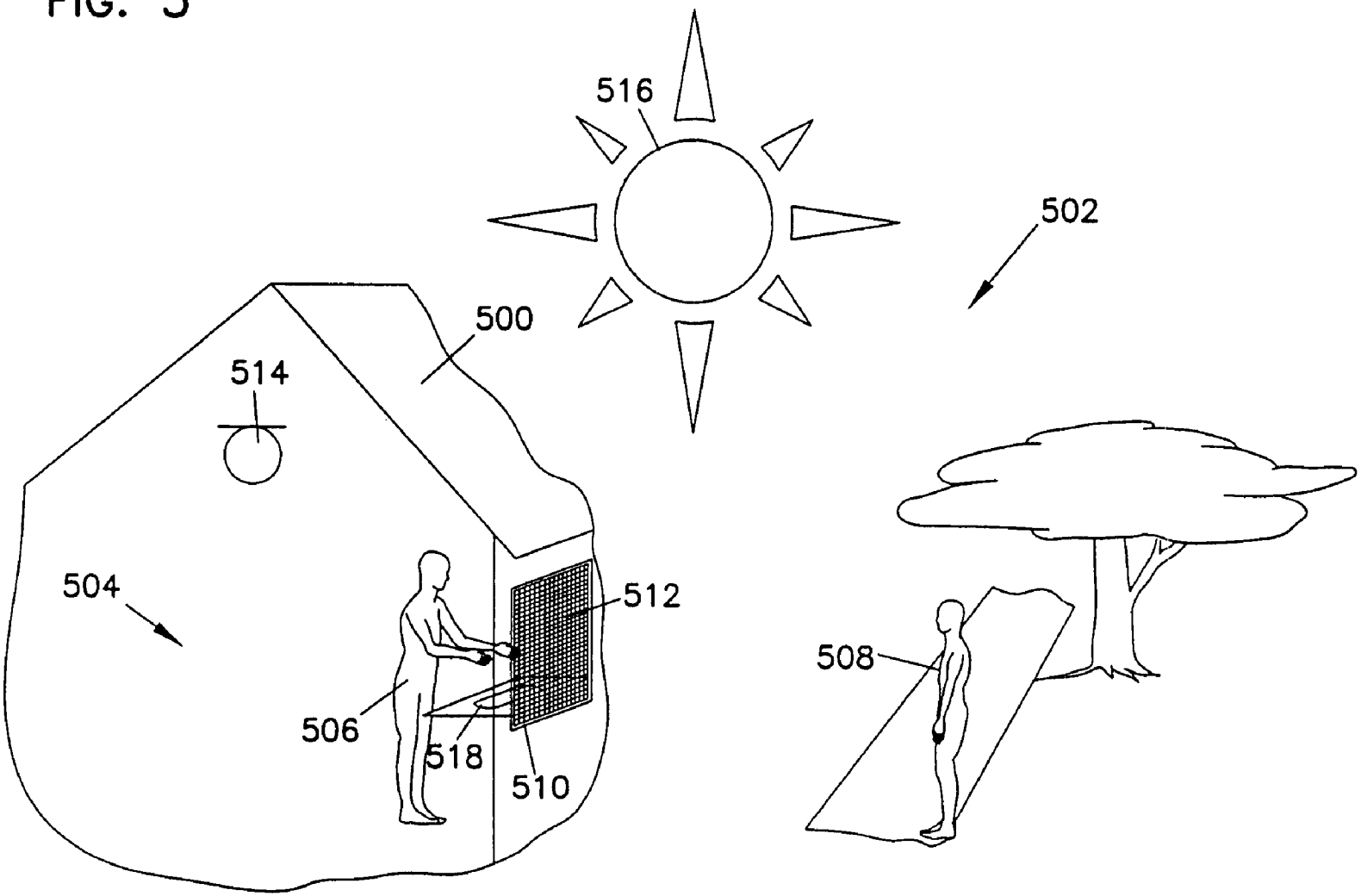
FIG. 5 is an illustration of inside and outside viewing perspectives of an insect screen on a window unit.

With reference to FIG. 5, a cross-sectional view of a dwelling 500 is shown to illustrate how inside and outside observers view screens. Dwelling 500 separates the outside 502 from the inside 504. An inside viewer 506 is illustrated inside 504 of the dwelling 500 while an outside viewer 508 is illustrated outside 502. Window 510 is located in a wall of dwelling 500 and also separates the inside 504 from the outside 502. Screen 512 covers the window 510 on the outside 502 side of window 510.

The inside viewer 506 in FIG. 5 is separated from window 510 by the width of sink 518, which represents a typical close range interior viewing distance, frequently about 2 feet. The closer the viewer 506 stands to the screen 512, the more obvious the screen 512 will appear. For example, at 12 inches, which is a relatively close range interior viewing distance, the normal visual acuity of the human eye is about 0.0035 inch (0.09 mm). Elements having a diameter of less than about 0.0035 inch will likely not be perceived by a viewer of normal eyesight at a distance of 12 inches (30.5 cm). Therefore, the perceived visibility is affected by the diameter of the screen elements and the distance between the viewer 506 and the screen 512. At about 24 inches, the normal visual acuity is about 0.007 inch. For this reason, elements having a diameter of about 0.007 inch will not be resolvable to a viewer at about 24 inches from the screening.

Inside a building or dwelling, interior lighting fixtures such as light 514 provide the primary interior light source that would reflect from the screen. Outside of the dwelling, the sun 516 provides a much stronger light source that will reflect off the screen 512. Accordingly, the reflectance of the screen will generally be of greater importance to the visibility of the screen to the outside viewer 508 than to the inside viewer 506, because much more light is incident on the screen from the exterior 502 than from the interior 504. However, the shape of the elements, which are normally round, may cause sunlight to be reflected into the interior of the building, impacting the visibility of the screen to an inside viewer.

The transmittance of the screen affects visibility of the screen for both the inside viewer 506 and the outside viewer 508. The inside viewer 506 views the exterior scene by the sunlight that is reflected off the outside objects and then transmitted through the screening 512. The less light transmitted through the screening 512, the more the inside viewer's perception of the exterior view is negatively affected by the screening. As discussed above in relation to FIG. 4, when looking through the screening, the exterior viewer sees light reflecting from or emanating from the objects on the interior side of the screening. As the transmittance of the screening decreases, the presence of the screening becomes more apparent.

The perspective of inside and outside viewers has been discussed so far with respect to a screen that is on the exterior side of a window. This is the configuration used in most double hung windows, sliding windows, and sliding doors. However, many window units have screens on the interior side of the window, such as casement windows or awning windows. Where the screen is inside of the glass, the reflectance and transmittance of the insect screening will still impact the visibility of the screen. Generally, screens on the outside of the glass are the most obvious type to the outside viewer, so this is the harder configuration to address for outside viewing. As discussed above, the size of the individual screen elements has an important impact on the visibility of a screen to an inside observer. If a screening possesses reflectance and transmittance qualities that are acceptable for outside viewing, and a sufficiently small element diameter, the screening will also be less visible to the inside observer than conventional insect screens, whether the screen is on the inside or outside of the glass.

Specular Versus Diffuse Reflectance

Figure 9:
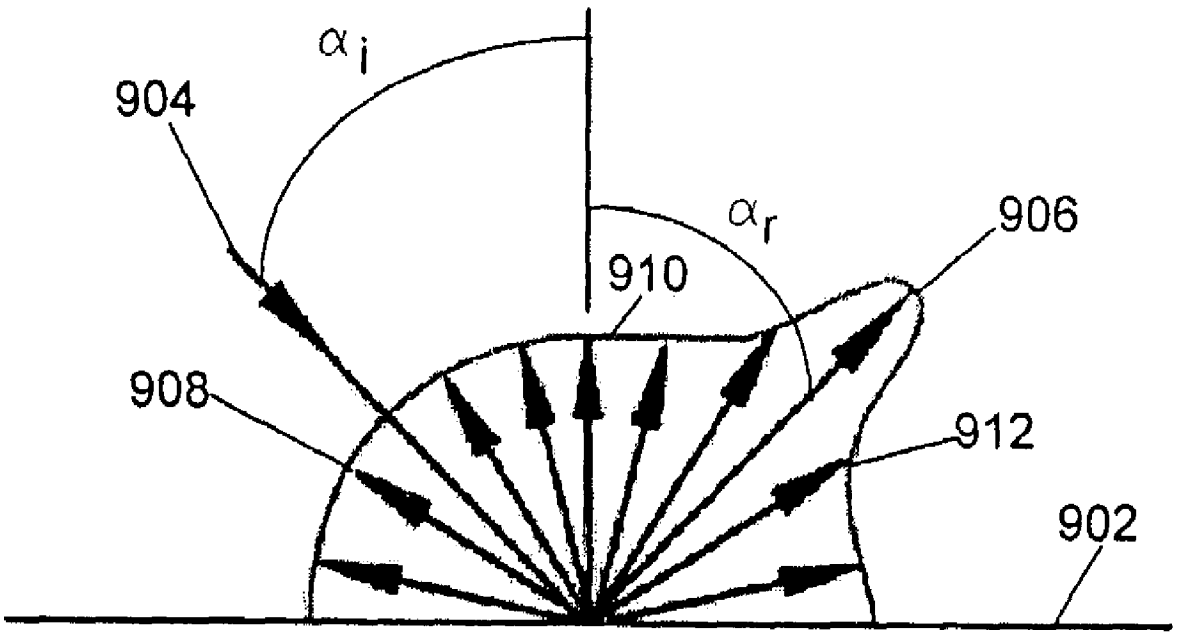
FIG. 9 is a diagram showing specular and diffuse reflections from a matte surface.

FIG. 9 illustrates two types of reflection that occur from surfaces: specular reflection and diffuse reflection. In specular reflection, light has an angle of reflection measured from the normal to the surface that is equal to the angle of incidence of the beam measured from the normal, where the reflected beam is on the opposite side of the normal to the surface from the incident beam. In diffuse reflection, an incident beam of light is reflected at a range of angles that differ significantly from the angle of incidence of the incident parallel beam of light.

In FIG. 9, light rays are shown interacting with a surface 902. Light ray 904 is incident on the surface 902 at an angle of incidence $\alpha_i$. A portion of the light ray 904 is specularly reflected as light ray 906, where the angle of reflection $\alpha_r$ is equal to the angle of incidence $\alpha_i$. However, light rays 908, 910, and 912 are examples of diffusely reflected light rays that are reflected at a range of different reflection angles.

For reducing the visibility of screening, diffuse reflection is preferred over specular reflection because diffuse reflection disperses the power of the incident light over multiple angles. In specular reflection, the light beam is generally redirected to the reflection angle while maintaining much of its power. Providing a dull or roughened surface increases diffuse reflection from a screen mesh.

Reflectance & Transmittance Testing Procedure

Measurements for reflectance and transmittance may be made with an integrating sphere spectrophotometer. For the purposes of the data presented herein, a Macbeth Color-Eye 7000 spectrophotometer, manufactured by GretagMacbeth of Germany, was used to obtain transmittance and reflectance measurements for wavelengths of 360 to 750 nm.

Figure 15:
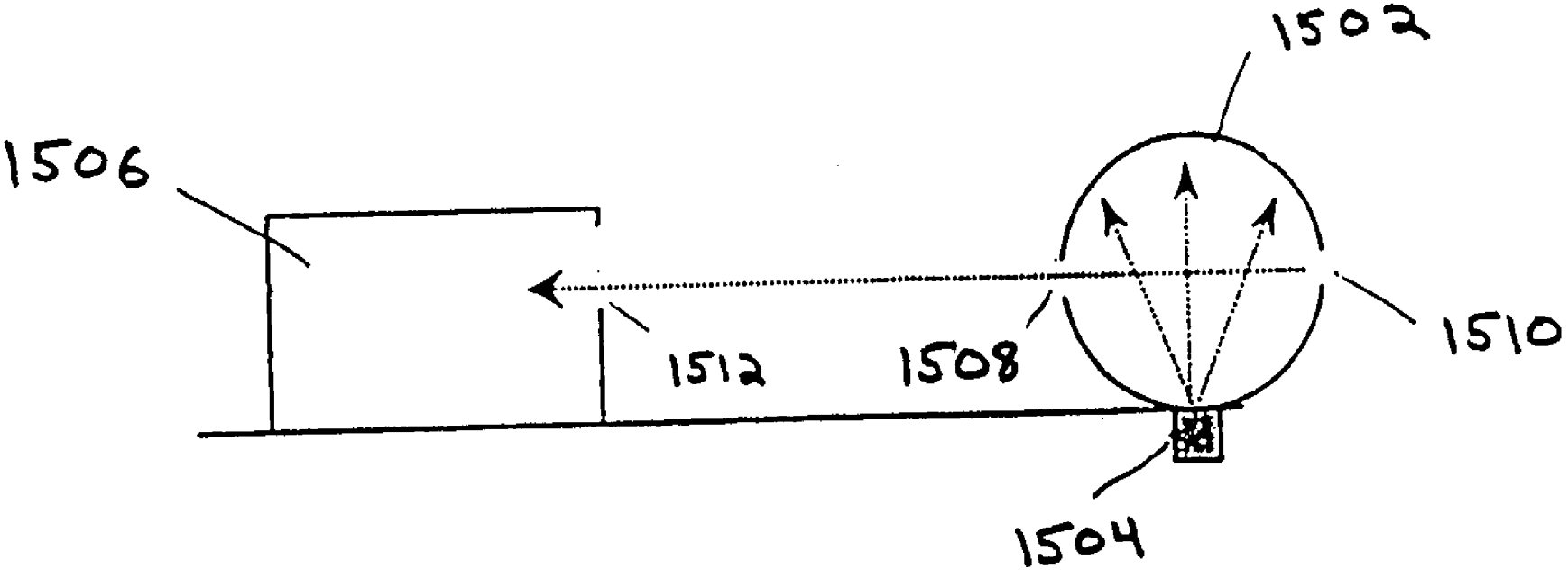
FIG. 15 is a diagram of an integrating sphere spectrophotometer for measuring the reflectance and transmittance of a screen material.

The spectrophotometer shown in FIG. 15 contains an integrating sphere 1502 useful when measuring samples in reflection or transmission. Integrating sphere 1502 contains front port 1510 and exit port 1508. The front port 1510 measures about 25.4 mm in diameter.

A xenon flash lamp 1504 is located at the base of the integrating sphere. Detector 1506 measures the amount of light emitted from integrating sphere 1502. Detector 1506 contains viewing lens 1512 for viewing the light. Viewing lens 1512 contains a large area view.

For reflectance measurement, the spectrophotometer is set to a measurement mode of: CRILL, wherein the letters correspond to the following settings for the machine: C—Reflection, specular included; R—Reflection; I—Included Specular, I—Included UV; L—Large Lens; L—Large Aperture. When measuring reflectance, the sample is held flat against the front port 1510. Next, a light trap is placed behind the sample to prevent stray light from entering integrating sphere 1502. The light source 1504 emits light into the integrating sphere 1502. Some of the light is reflected off the sample and exits the integrating sphere 1502 through the exit port 1508. Once the light exits the exit port 1508, it enters the detector 1506 through viewing lens 1512. The spectrophotometer produces a number that is a ratio indicating the light reflected by the sample relative to the light reflected by a perfectly reflective surface.

For a transmittance measurement, the spectrophotometer is set to a measurement mode of: BTIILL, wherein the letters correspond to the following settings for the machine: B—Barium; T—Transmittance; I—Included Specular, I—Included UV; L—Large Lens; L—Large Aperture. The front port 1510 of the spectrophotometer is blocked with an object coated with barium oxide, identical to the interior surface of the sphere 1502. When measuring the transmittance of a sample, it is necessary to hold the sample flat against the exit port 1508 of the integrating sphere 1502. The light source 1504 emits light into the integrating sphere 1502. Some of the light exits the integrating sphere 1502 through exit port 1508. Once the light that is transmitted through the sample enters the detector 1506 through viewing lens 1512, the spectrophotometer produces a number that is a ratio indicating the light transmitted by the sample relative to the light transmitted where there is no sample.

Data collected for reflectance and transmittance for a number of screen samples will be described below with respect to FIGS. 6 and 7.

Data for Reflectance and Transmittance

Table 1 contains average values of test data for optical qualities of insect screening embodiments.

TABLE 1

Optical Data for Examples

| Sample | Description | Transmittance | Reflectance |
|---|---|---|---|
| 1 | Black Zn Cr | 0.828 | 0.006 |
| 2 | Flat Paint | 0.804 | 0.012 |
| 3 | Glossy Paint | 0.821 | 0.014 |
| 4 | Black Ink | 0.874 | 0.013 |
| 5 | PVD Cr(x)C(y) | 0.887 | 0.019 |
| 6 | Stainless Steel Base | 0.897 | 0.044 |

Examples of the present invention will now be described. Six different samples were prepared and tested for optical qualities related to the present invention.

Figure 10:
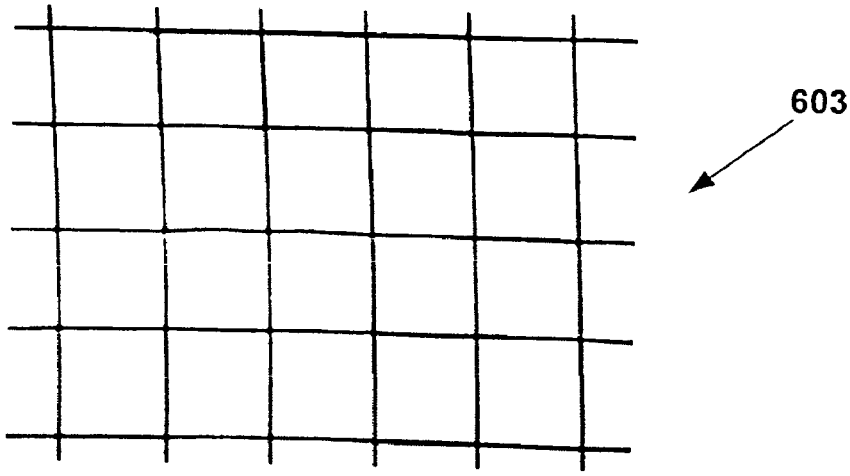
FIG. 10 is a photograph taken through a microscope of uncoated screen elements.

Each of Samples 1–6 was formed by starting with a base screening of stainless steel elements having a diameter of 0.0012 inch. The elements are made of type 304 stainless steel wire. The base screening has 50 elements per inch in both horizontal and vertical directions. It is a woven material and has openings with a dimension of 0.0188 inch by 0.0188 inch. The open area of this base material is about 88%, measured experimentally using a technique that will be described further herein. This material is commercially available from TWP, Inc. of Berkley, Calif. Sample 6 is the base screening without any coating. FIG. 10 is a photograph of Sample 6 taken through a microscope.

Figure 11:
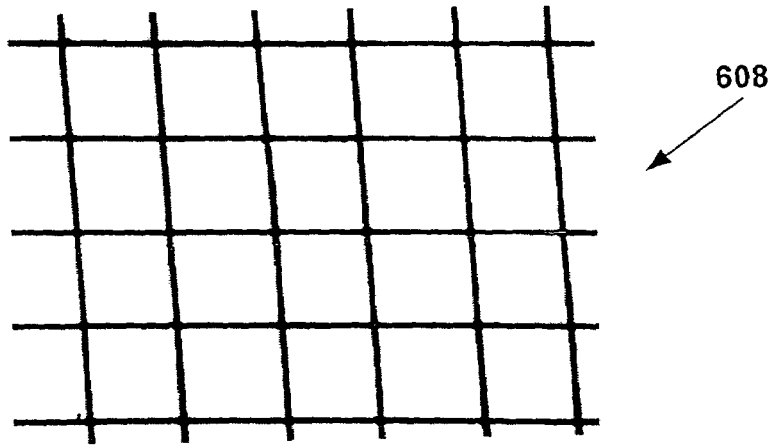
FIG. 11 is a photograph taken through a microscope of stainless steel screen elements coated with a coating of electrodeposited black zinc.

To form Sample 1, the base screening was coated by electroplating it with zinc and then a conversion coating of silver chromate was applied. The zinc reacts with the silver chromate to form a black film on the surface of the screen elements. A photograph of Sample 1 taken through a microscope is shown in FIG. 11. The black zinc coating bonds the horizontal and vertical screen elements together at their intersections. The coating increases the thickness of the screen element and therefore reduces the transmittance of the resulting screening by about 0.07 compared to the uncoated screening of Sample 6. The black finish decreases reflectance of incident light dramatically compared to the uncoated Sample 6.

Figure 12:
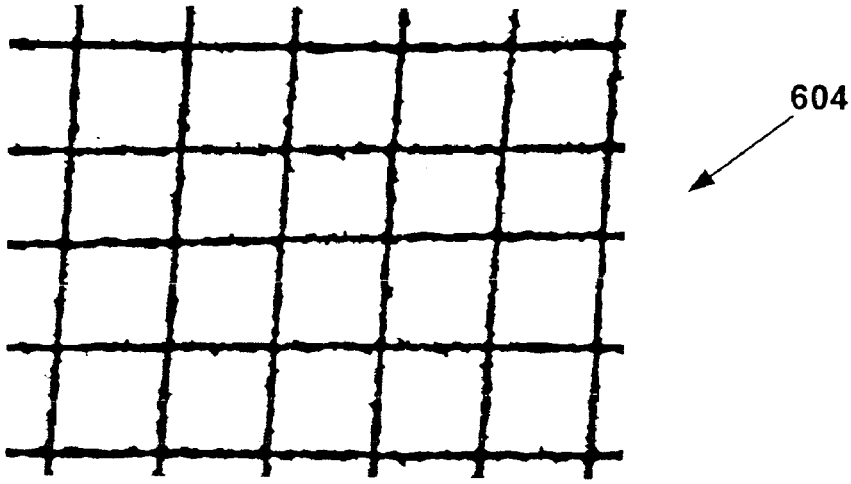
FIG. 12 is a photograph taken through a microscope of stainless steel screen elements coated with flat paint.
Figure 13:
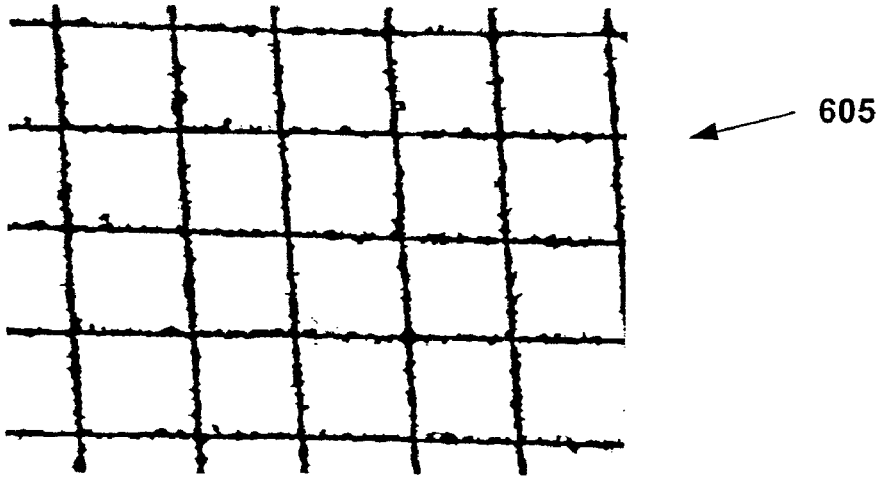
FIG. 13 is a photograph taken through a microscope of stainless steel screen elements coated with gloss paint.

To form Samples 2 and 3, the base screening was coated with about two to three coats of flat black paint and glossy black paint, respectively. As the paint was being applied manually, the painter visually inspected the surface and attempted to apply a uniform coating of paint. Depending on the speed of the spray apparatus passing over the various portions of the surface, two or three coats were applied to different areas of Samples 2 and 3, based on the painter's visual observations, to achieve a fairly even application of paint. Photographs of Samples 2 and 3 taken through a microscope are shown in FIGS. 12 and 13, respectively. The paint coating joins the horizontal and vertical screen elements together at their intersections and provides a black finish. The coating increases the thickness of the screen element and therefore reduces the transmittance of the resulting screening compared to the uncoated screening of Sample 6. The black color of both Samples 2 and 3 decreases reflectance of incident light compared to the uncoated Sample 6, with the flat black paint of Sample 2 having a lower reflectance than the glossy paint.

Sample 4 was coated with black ink. The application of ink to the screening does not significantly bond or join the horizontal and vertical screen elements together at their intersections. The coating of ink increases the thickness of the screen element a small amount and therefore reduces the transmittance of the resulting screening compared to the uncoated screening of Sample 6. The black finish decreases the reflectance of incident light compared to the uncoated Sample 6.

Figure 14:
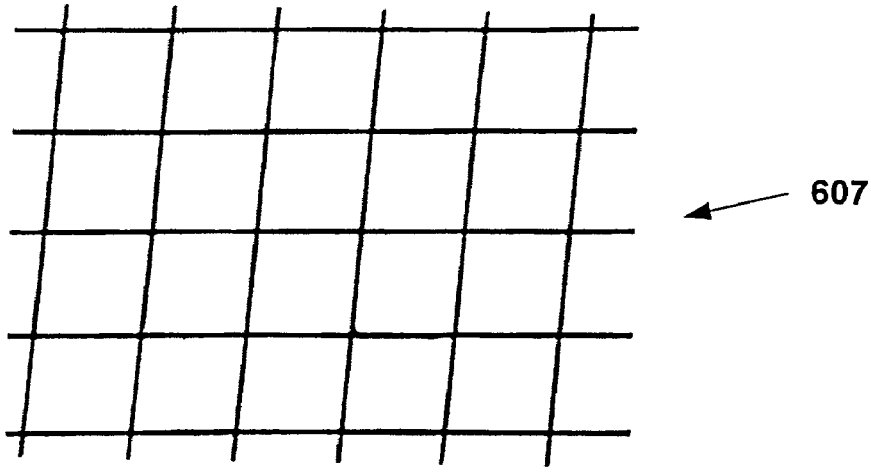
FIG. 14 is a photograph taken through a microscope of stainless steel screen elements coated with chromium carbide through a physical vapor deposition (PVD) process.

Sample 5 was coated with chromium carbide by physical vapor deposition (PVD). A photograph taken through a microscope of Sample 5 is shown in FIG. 14. The chromium carbide coating does not bond the horizontal and vertical screen elements together at their intersections, but does provide a black finish. The coating increases the thickness of the screen element very slightly and therefore reduces the transmittance of the resulting screening compared to the uncoated screening of Sample 6. The black finish decreases reflectance of incident light compared to the uncoated Sample 6.

Several commercially available insect screenings were tested for their optical qualities as a basis for comparison to the samples of the invention. The following table contains average values of actual test data from each material.

TABLE 2

Optical Data for Comparative Examples

| Sample | Description (material, color, manufacturer, trade name if any) | Transmittance | Reflectance |
|---|---|---|---|
| A | Al, Gray, Andersen Windows | 0.658 | 0.025 |
| B | FG, Black, Andersen Windows | 0.576 | 0.029 |
| C | FG, Black, Phifer | 0.625 | 0.025 |
| D | Al, metallic, Phifer, Brite-Kote ™ | 0.779 | 0.095 |
| E | Al, Charcoal, Phifer | 0.741 | 0.019 |
| F | Polyester, Black, Phifer, Pet Screen ® | 0.363 | 0.024 |
| G | FG, Gray, Phifer | 0.652 | 0.060 |

Samples A, D and E are made of aluminum elements. Samples B, C, and G are made of vinyl-coated fiberglass elements. Sample F is made of a polyester material.

Figure 6:
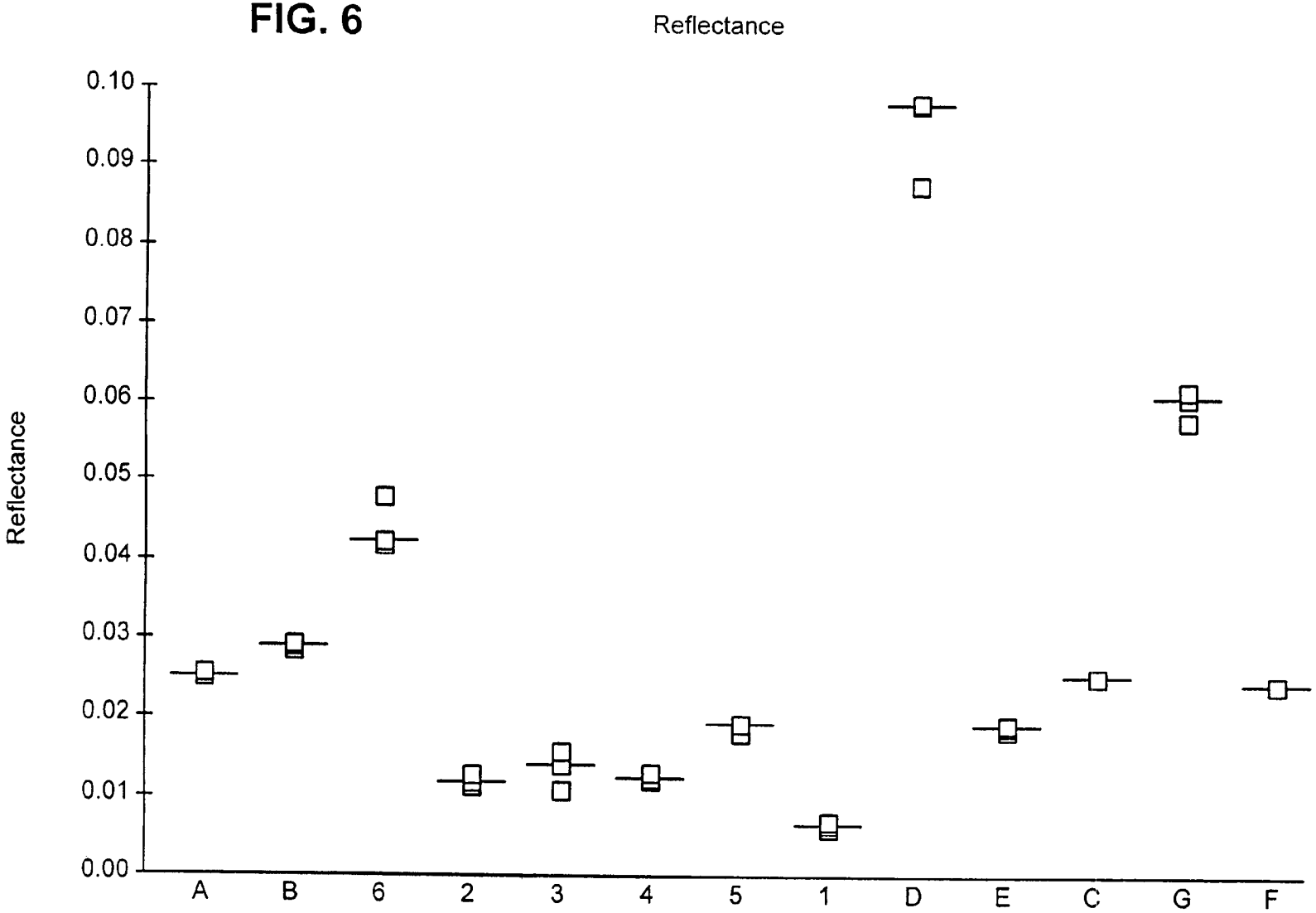
FIG. 6 is a graph showing the reflectance for embodiments of the invention and comparative example screen embodiments.

FIG. 6 shows a comparison of reflectance values for both commercially available screening Samples A-G and screenings of the present invention Samples 1–6. Lower values for reflectance correspond to screening that appears more invisible because less light is reflected in the direction of the viewer. Samples 1–4 have the lowest values for reflectance. The least reflective commercially available Sample E has an average reflectance value of 0.019, which is equivalent to the average value of the second-most reflective Sample 5.

Figure 7:
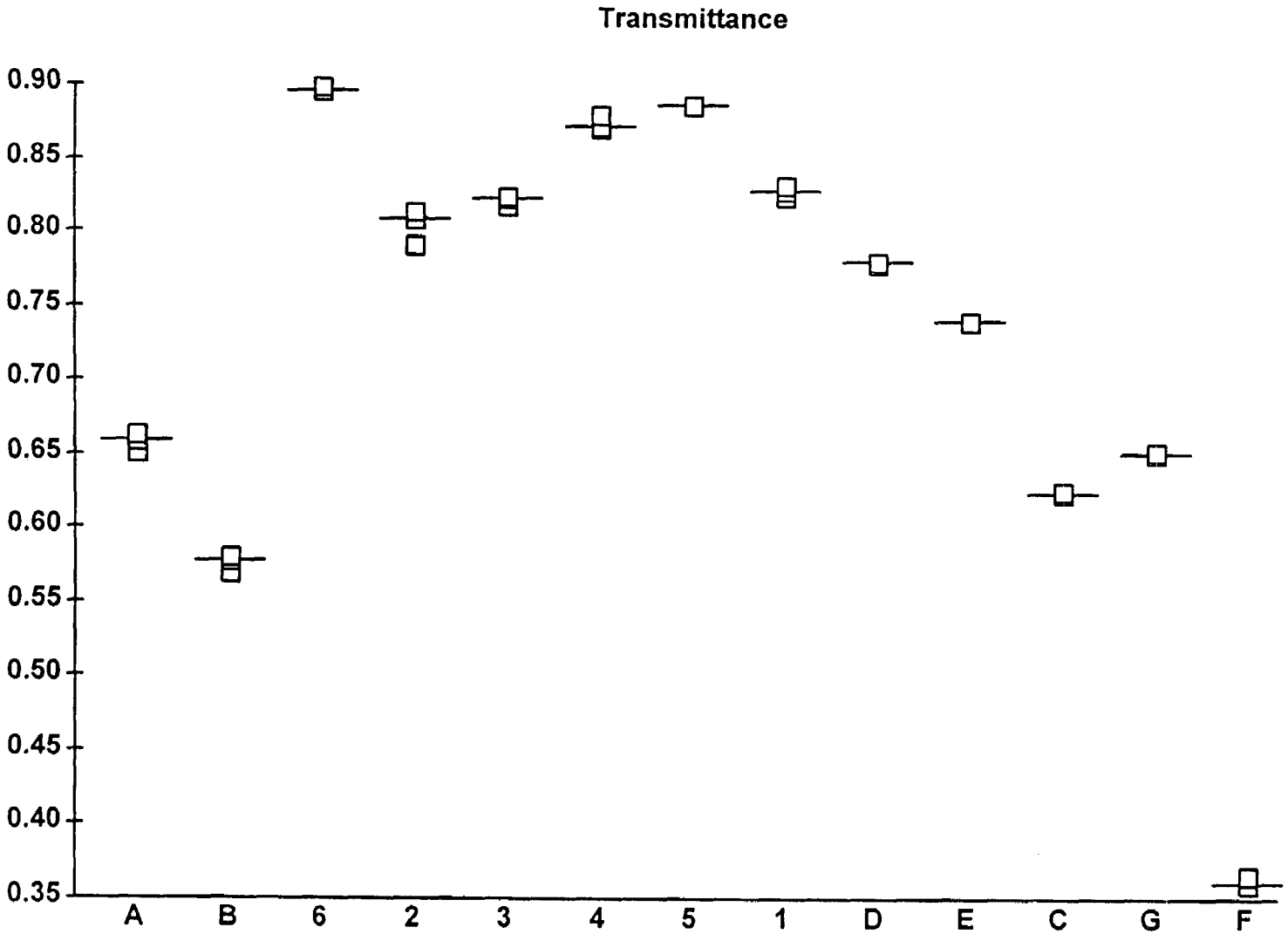
FIG. 7 is a graph showing the transmittance for embodiments of the invention and comparative example screen embodiments.

FIG. 7 shows a comparison of transmittance values for the screen materials set forth in the tables above. Higher values for transmittance correspond to screens with preferred optical qualities. Screening Samples 1–6 have higher transmittance values than the commercially available Samples A–G.

Figure 8:
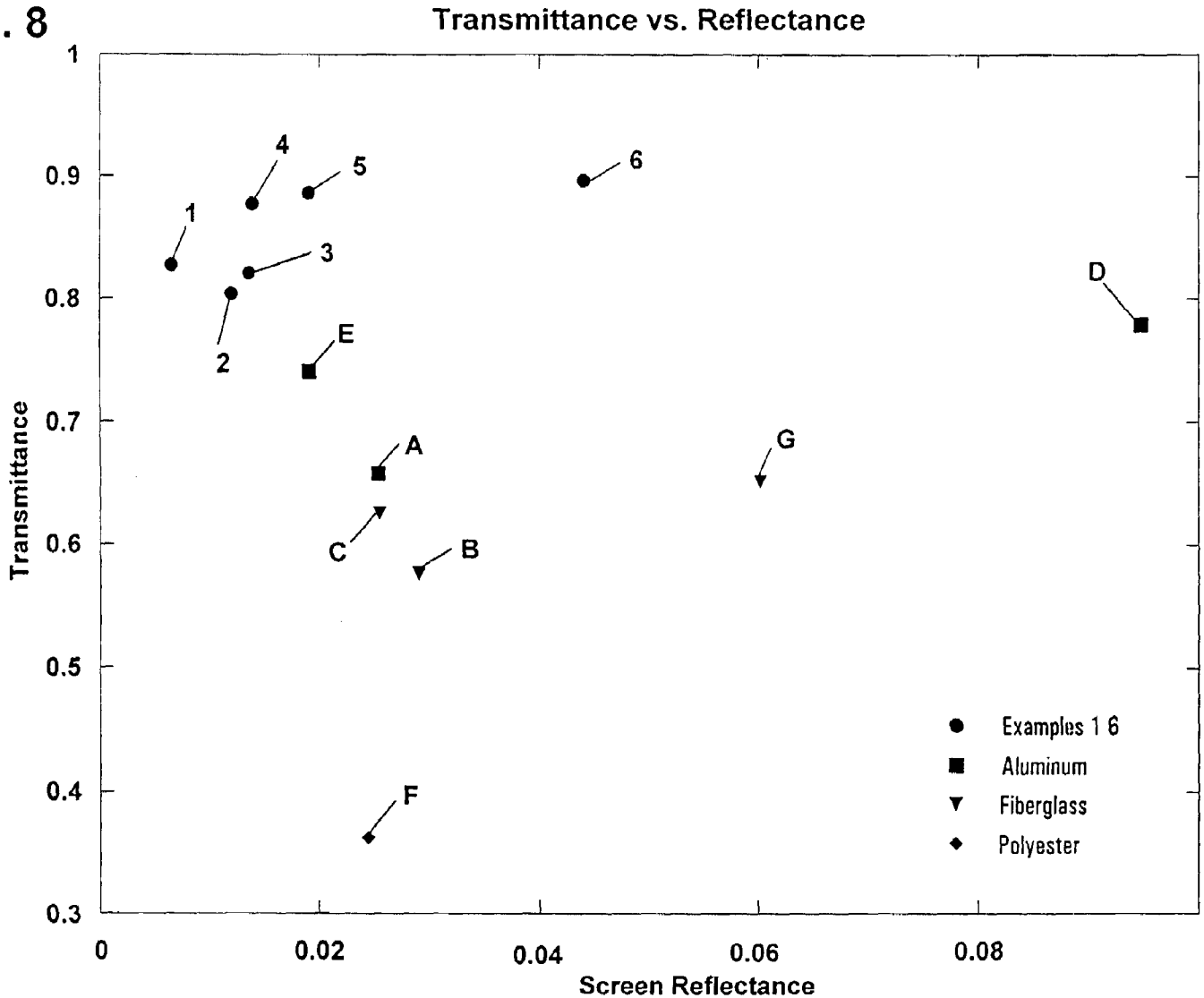
FIG. 8 is a graph showing the transmittance versus the reflectance for embodiments of the invention and comparative example screen embodiments.

FIG. 8 is a graph of transmittance versus reflectance for the screen materials set forth in the tables above. Samples 1–5 all have a transmittance of at least about 0.80 and a reflectance of no more than about 0.020. None of the comparative samples have a transmittance greater than 0.78. None of the comparative samples have both a transmittance of greater than 0.75 or 0.80 and a reflectance of less than 0.020, 0.025, 0.030 or 0.040, while samples 1–5 have those qualities.

Percent Open Area

The percent open area also relates to the invisibility of an insect screen. Assuming a square mesh, the percent open area (POA) can be computed as follows:

$$POA=((W/(D+W))^2*100$$

where:
D=element diameter, and
W=opening width.

Many commercially available screenings have a rectangular mesh. The POA for a rectangular mesh can be computed as follows:

$$POA=(1-N*D)(1-n*d)*100$$

where:
N=number of elements per inch in a first direction,
D=element diameter of the elements extending in the first direction,
n=number of elements per inch in a second direction, and
d=element diameter of the elements extending in the second direction Generally, screens appear less visible if they contain a larger percentage of open area. For example, Sample 6 has about 88% open area, corresponding to 50 elements per inch in either direction, screen elements of woven 0.0012-inch (0.03-mm) type 304 stainless steel wire, and openings sized 0.0188 inch (0.5 mm)×0.0188 inch (0.5 mm).

In contrast, standard insect screening has about 70% open area and often have opening sizes of 0.05 inch by 0.04 inch. Standard gnat-rated insect screens often have a percent open area of about 60% and opening sizes of about 0.037 inch by 0.037 inch with elements of about 0.013 diameter.

Decreasing the wire diameter can increase the percent open area. It is desirable to select a wire diameter that allows for the largest percent open area while maintaining suitable strength. Screening is commercially available made of unwelded 5056 aluminum wire of 0.011-inch (0.28 mm) diameter. The term unwelded indicates that the horizontal and vertical elements are not bonded or welded together at their intersections. Importantly, type 304 stainless steel wire has almost three times the tensile strength of 5056 aluminum wire. Accordingly it is possible to use a smaller wire diameter of 0.0066 inch (0.17 mm) of type 304 stainless steel to achieve tensile strength similar to the 5056 aluminum screening.

Additional materials may be selected within the scope of the present invention to increase the percent open area by decreasing the diameter of the screen elements. These materials include, but are not limited to: steel, aluminum and its alloys, ultra high molecular weight (UHMW) polyethylene, polyesters, modified nylons, and aramids. It is also possible to use an array of man-made fibers for generalized use in the industrial arts. An example of this material is sold under the trademark KEVLAR®.

Generally, the percent open area corresponds roughly to the percentage of transmittance through a particular screening. However, accepted techniques for calculating percent open area like those expressed above do not account for the elements crossing each other in the screening, and therefore over-estimate the percent open area by a few percent. The amount of error inherent in these calculations depends on the thickness of the wire.

Strength of Screen Elements

Figure 18:
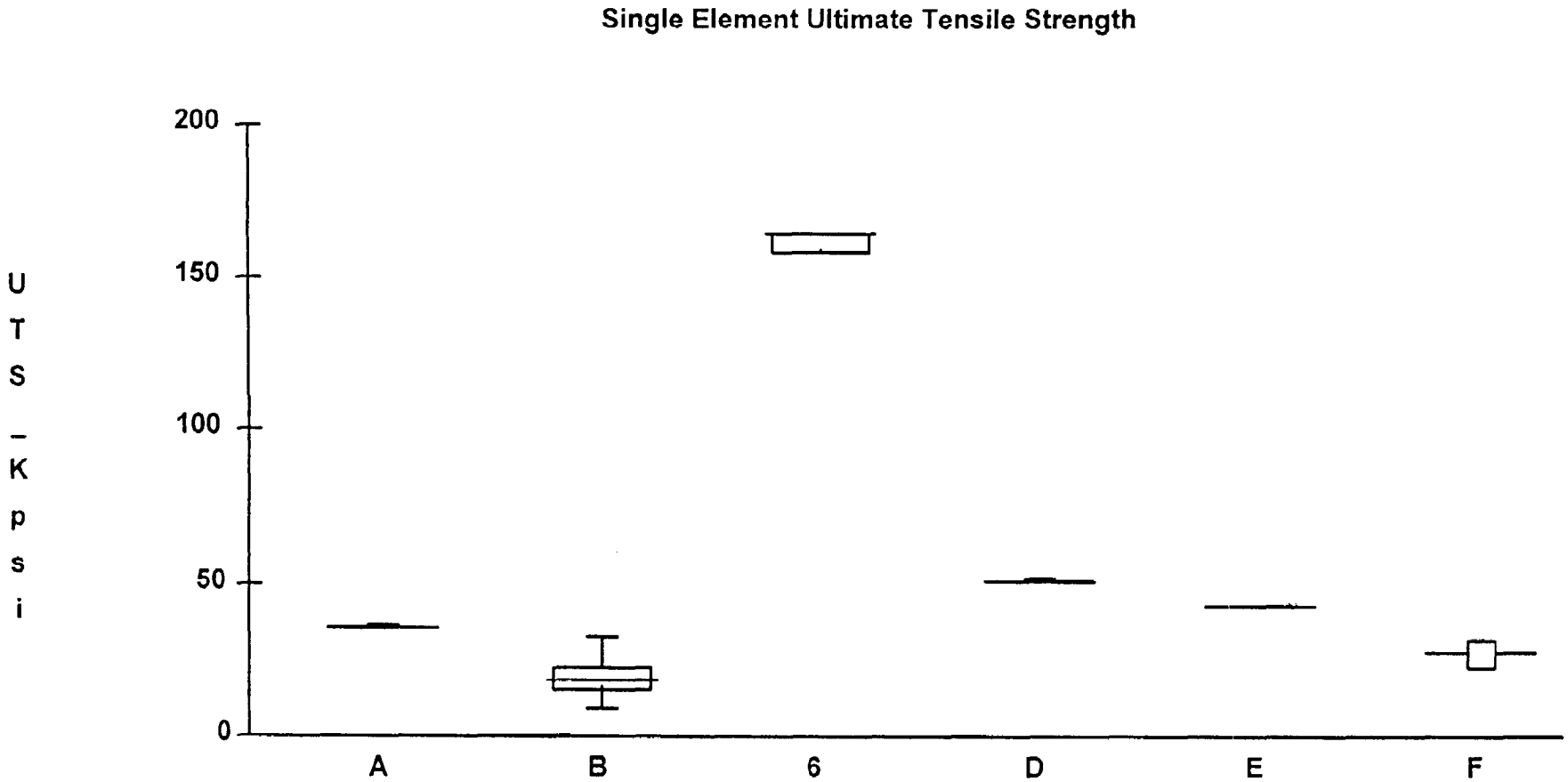
FIG. 18 is a graph showing the single element ultimate tensile strength for embodiments of the invention and comparative example screen embodiments.

FIG. 18 illustrates the single element ultimate tensile strength for elements of Sample 6 and comparative Samples A, B, D, E and F. Samples 1–5 consist of the same material as Sample 6 but with a coating added. Therefore Samples 1–5 have ultimate tensile strengths that are about the same as for Sample 6. The electroplated zinc coating applied to Sample 1 may in fact increase the ultimate tensile strength of those elements.

As discussed above, the diameter of the elements in Sample 6 is much smaller than commercially available insect screen elements. Therefore, inventive elements must have a higher tensile strength than elements used in prior screening materials to achieve similar strength specifications as prior screening materials. In FIG. 18, ultimate tensile strength is charted in Ksi or 1000×psi. The tensile strength for the elements of Sample 6 is about 162 Ksi, which is over three times stronger than Sample D, which is the strongest element in the commercially available Samples A, B, D, E and F. A minimum desirable tensile strength for the screen elements is about 5500 psi or more, or about 6000 psi or more. Preferably, at least about a tenth of pound of force is required to cause a single screen element to break. About 0.16 pound force is required to break a 0.0012-inch stainless steel element of Sample 6.

Snag Resistance

Snag resistance is a measure of how a screen reacts to forces that could cause a break, pull, or tear in the screen elements, such as clawing of the screening by a cat. Snag resistance is important because birds, household animals, and projectiles come into contact with screens.

Figure 17:
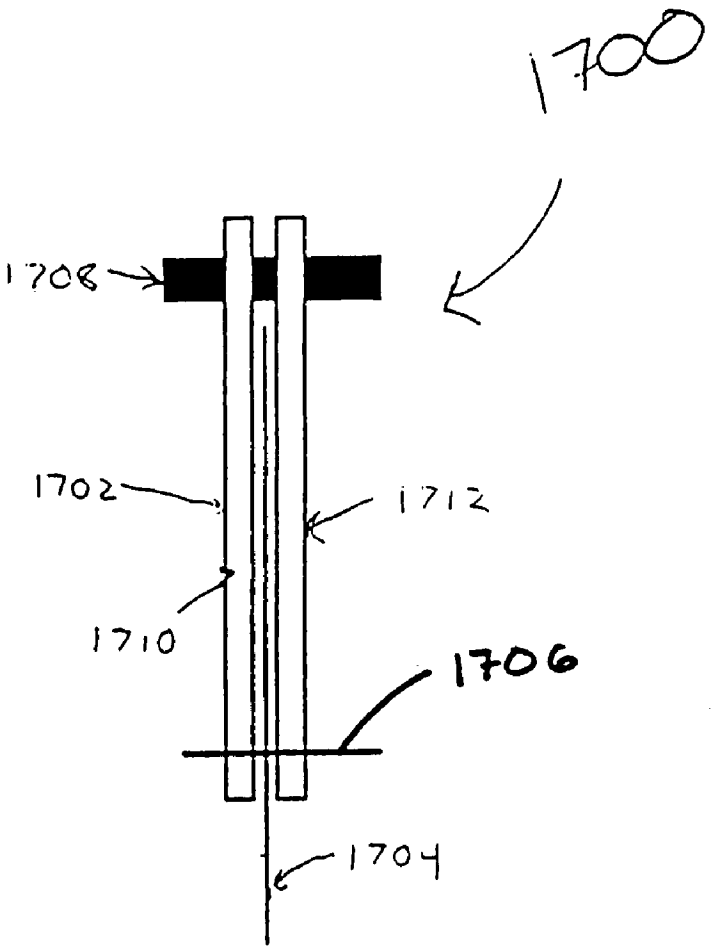
FIG. 17 is a side view of the test fixture of FIG. 16.
Figure 16:
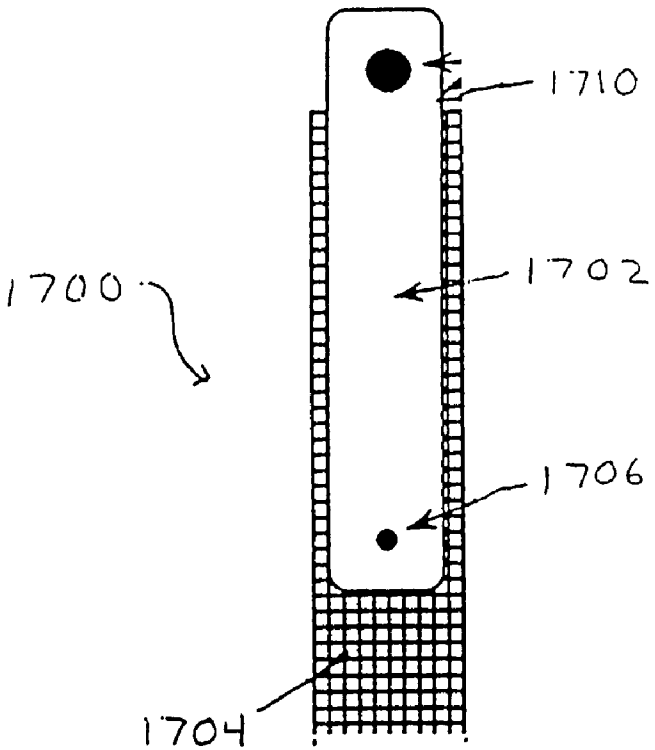
FIG. 16 is a front view of a test fixture for measuring the snag resistance of a screen material.

FIGS. 16 and 17 show a test fixture 1700 used to measure snag resistance. Test fixture 1700 includes a screen guide 1702 made from two 0.5×6-inch pieces of fiberglass laminate material 1710 and 1712. The pieces 1710 and 1712 are approximately 0.060 inches thick and are used to guide the screen cloth 1704 during the test by placing the screen cloth 1704 between pieces 1710 and 1712 of screen guide 1702. The pieces 1710 and 1712 contain an upper clearance hole to attach the screen guide 1702 to an instrument that measures the maximum load. Pieces 1710 and 1712 also contain a lower clearance hole to support a snagging mandrill 1706.

When preparing a sample of screening 1704 for a test, a 2-inch×6-inch sample strip of screen 1704 is cut out so that the warp and weft directions lie with and perpendicular to the test direction. The warp direction is along the length of a woven material while the weft direction is across the length of the woven material. The screen guide 1702 is hung from a load cell gooseneck and a snagging mandrill 1706 is carefully passed through the screen 1704. The test is started and the snag mandrill 1706 is moved through the screen 1704 at the rate of 0.5 inch/minute and continued until 0.5 inch is traveled. At this point, the test is terminated and the sample is removed. Care must be taken not to damage the sample when removing it from the test fixture. Several measurements may be recorded, including the maximum load obtained and the load at a specific extension divided by the extension (lb-force/in).

Samples were also visually inspected to determine the failure mode. Three failure modes are generally possible with insect screens. The first failure mode is element breakage because the joints hold and the sections of element between the joints break. The second failure mode is joint breakage. This occurs when the elements hold and the joints break. The third failure mode occurs when the elements break and the joints slip. This third failure mode is a combination of element breakage and joint breakage. Generally, element breakage is the preferred failure mode because it disturbs less surface area on the screen.

Figure 19:
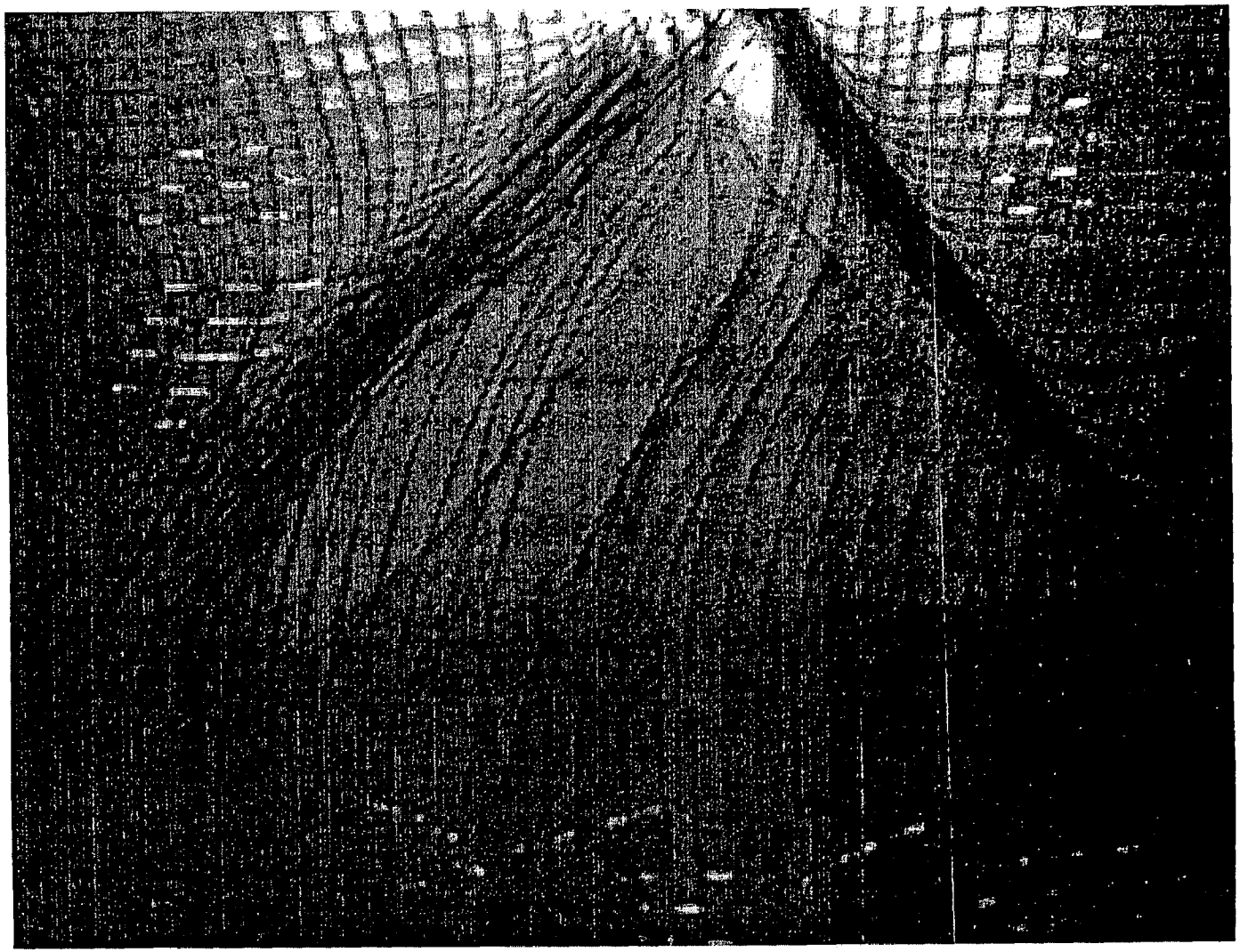
FIG. 19 is a depiction of a snag on an unbonded insect screening.

FIG. 19 illustrates a screen with unbonded elements corresponding to Sample 6 after undergoing the snag resistance test described above. The screen elements appear to have slid together due to the force of the snagging mandrill 1706. FIG. 19 is generally an example of the joint breakage failure mode. As no coating forms a bond at the intersections of the elements in Sample 6, any joint strength is due to frictional forces between the elements in the weave.

Figure 20:
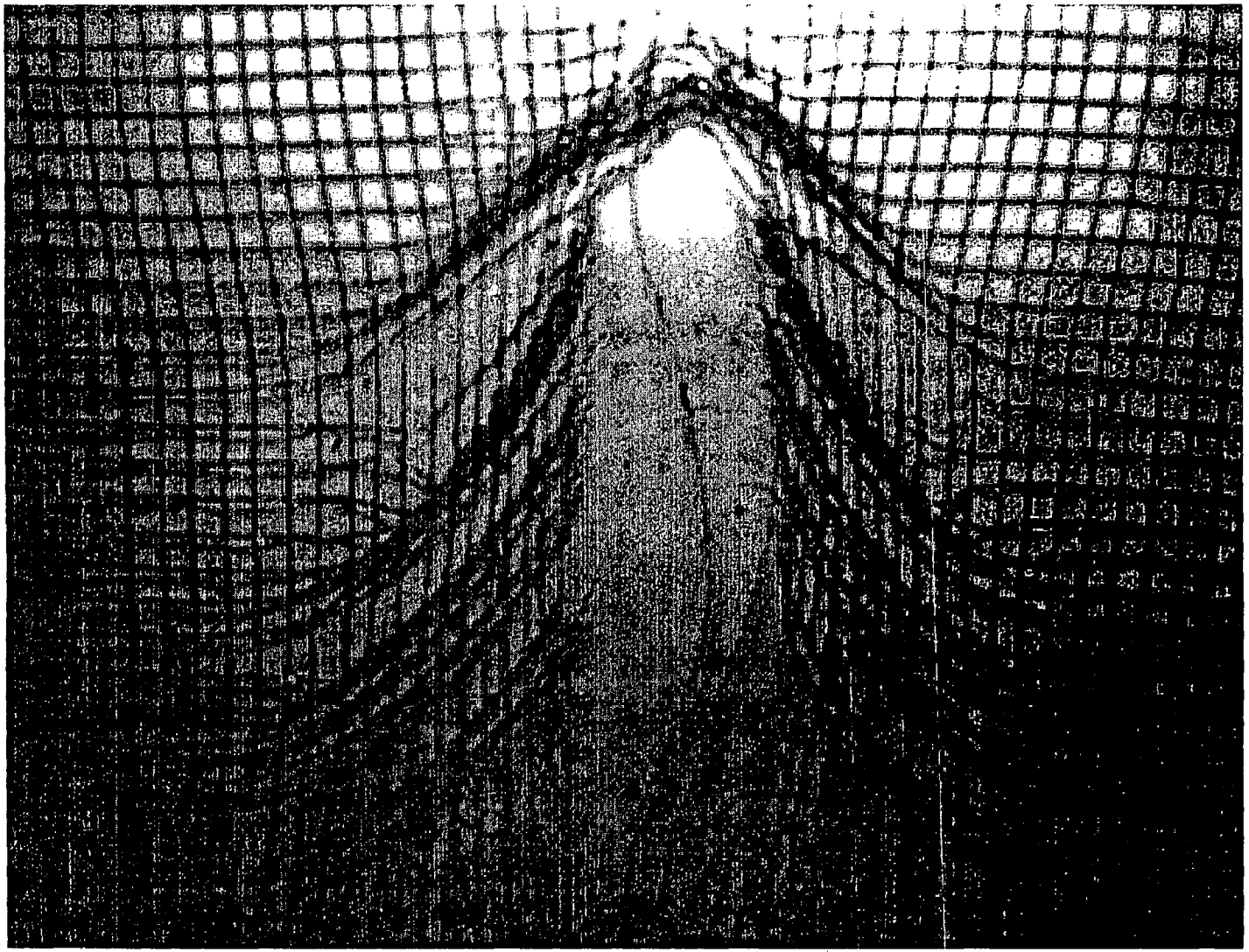
FIG. 20 is a depiction of a snag on an insect screening having a paint coating.
Figure 21:
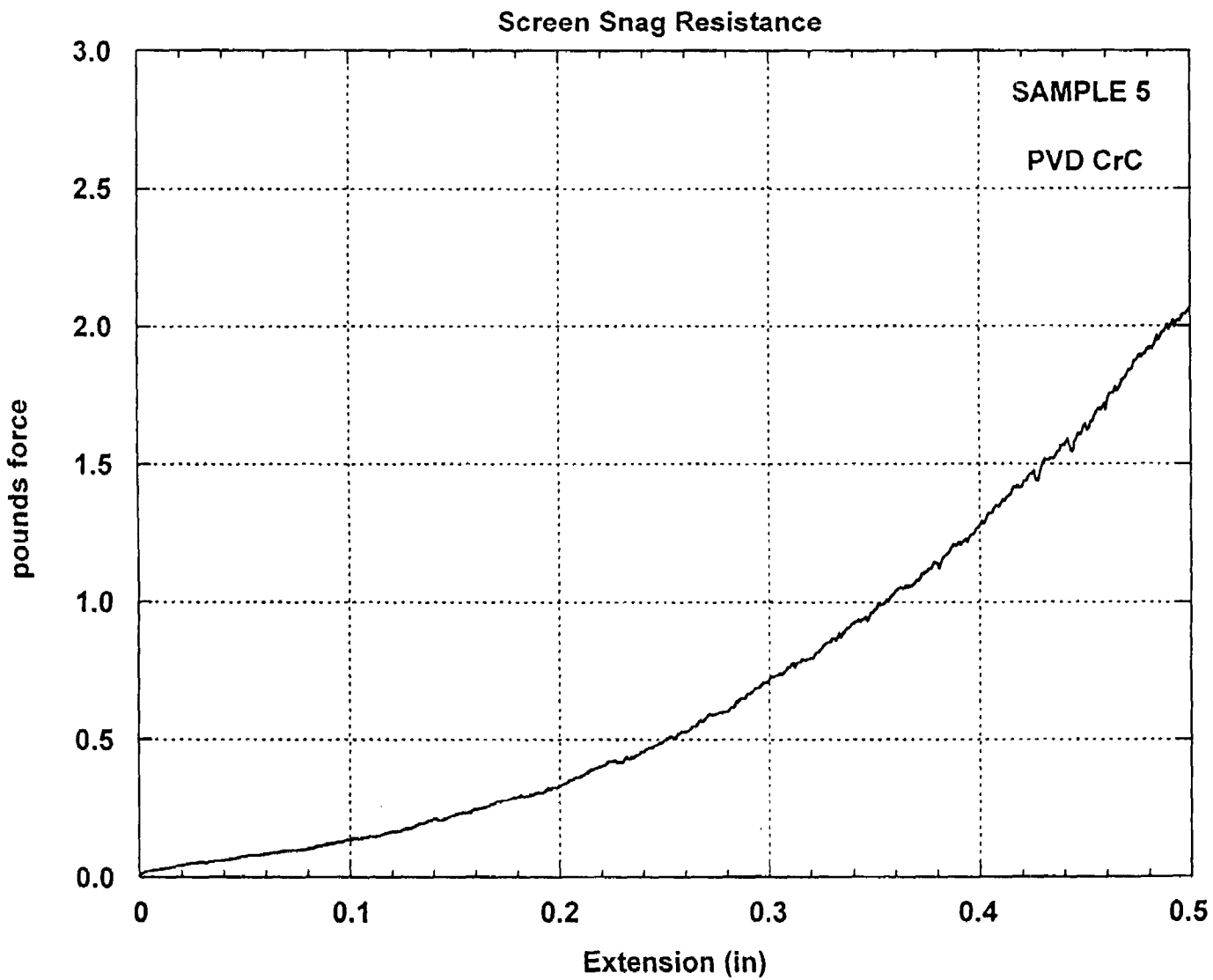
FIGS. 21–25 are graphs plotting pounds of force applied to a rigid element versus inches of travel as the element moved against a screen mesh fabric for a snag resistance test for five different examples of the invention.
Figure 22:
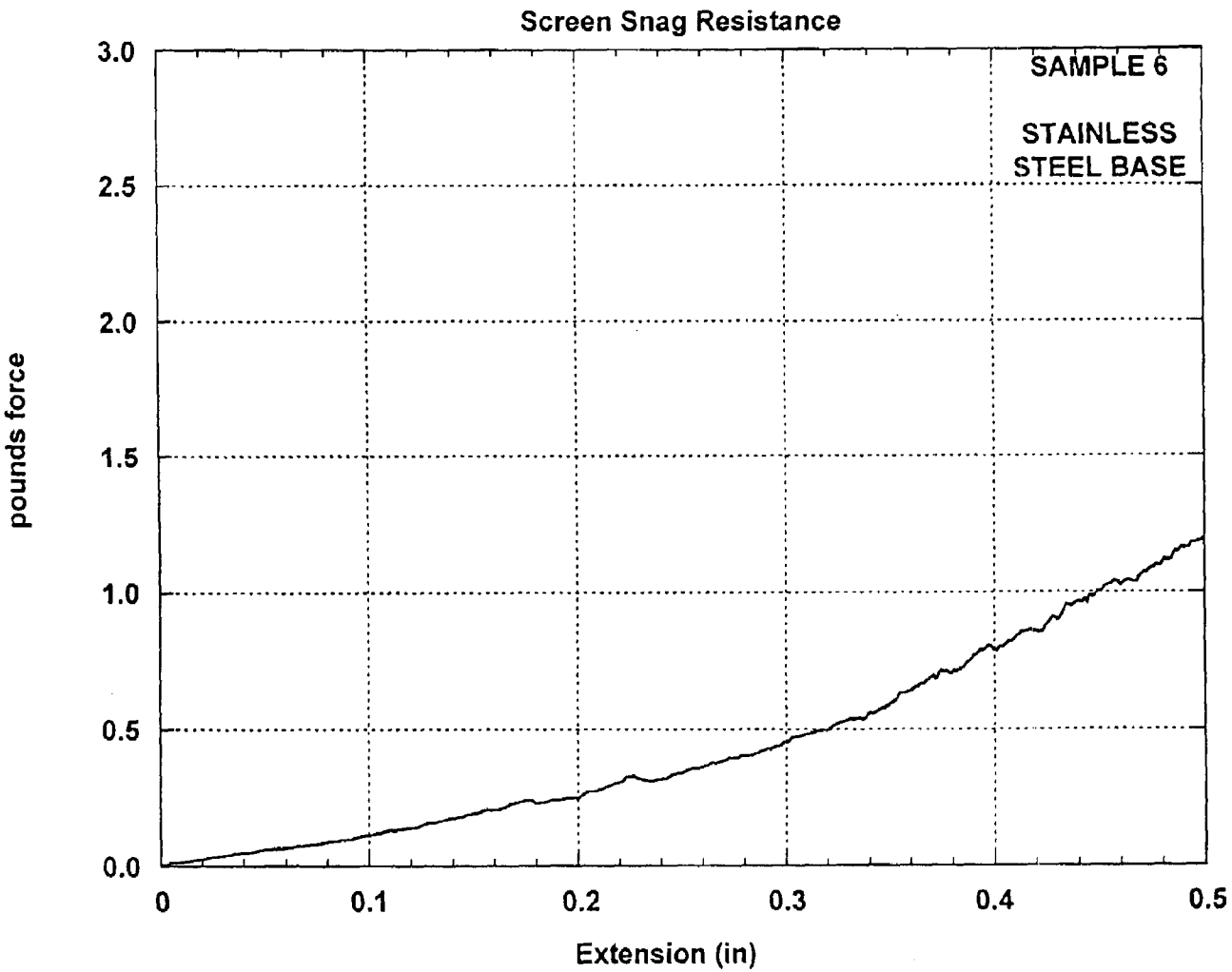
Figure 23:
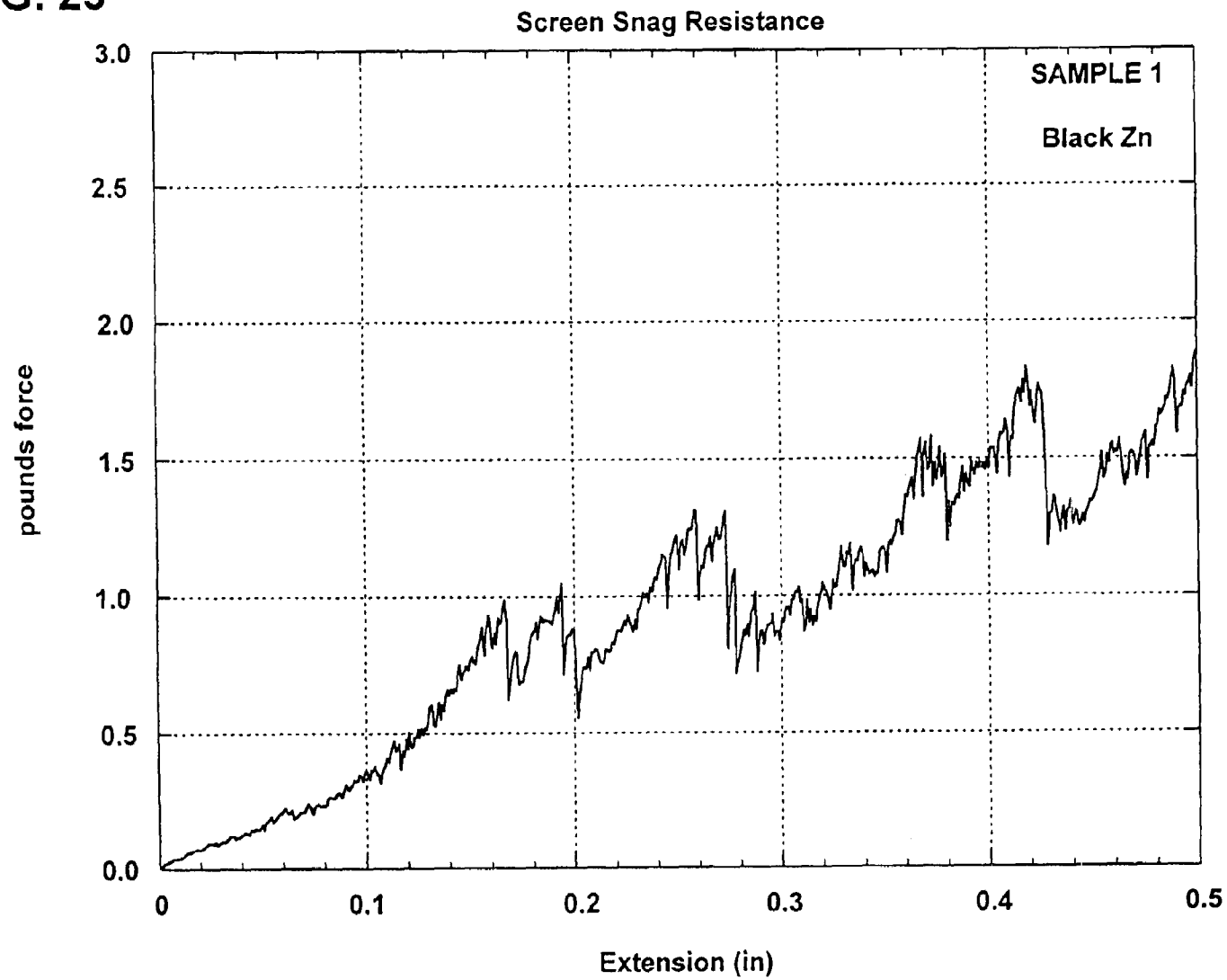
Figure 24:
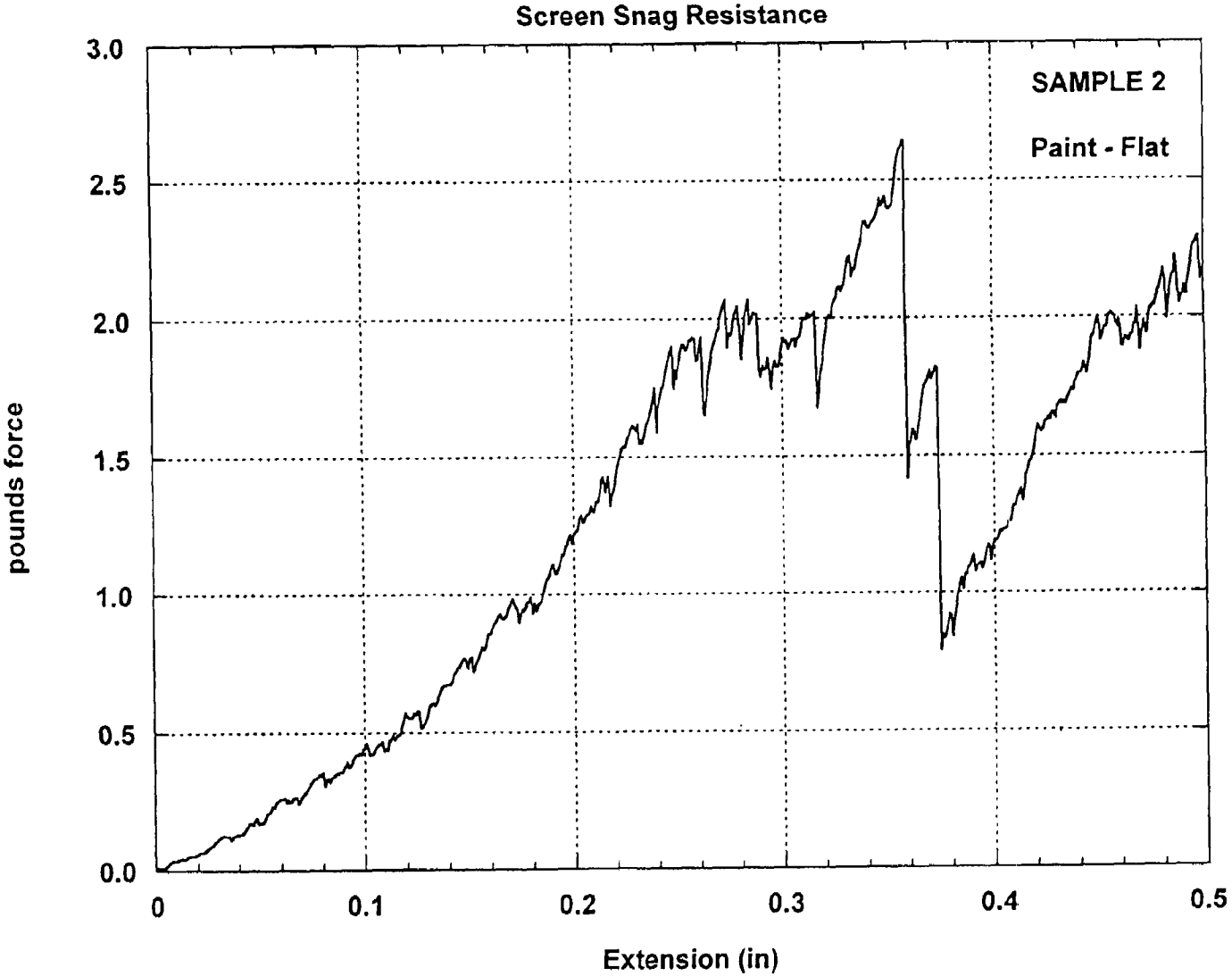
Figure 25:
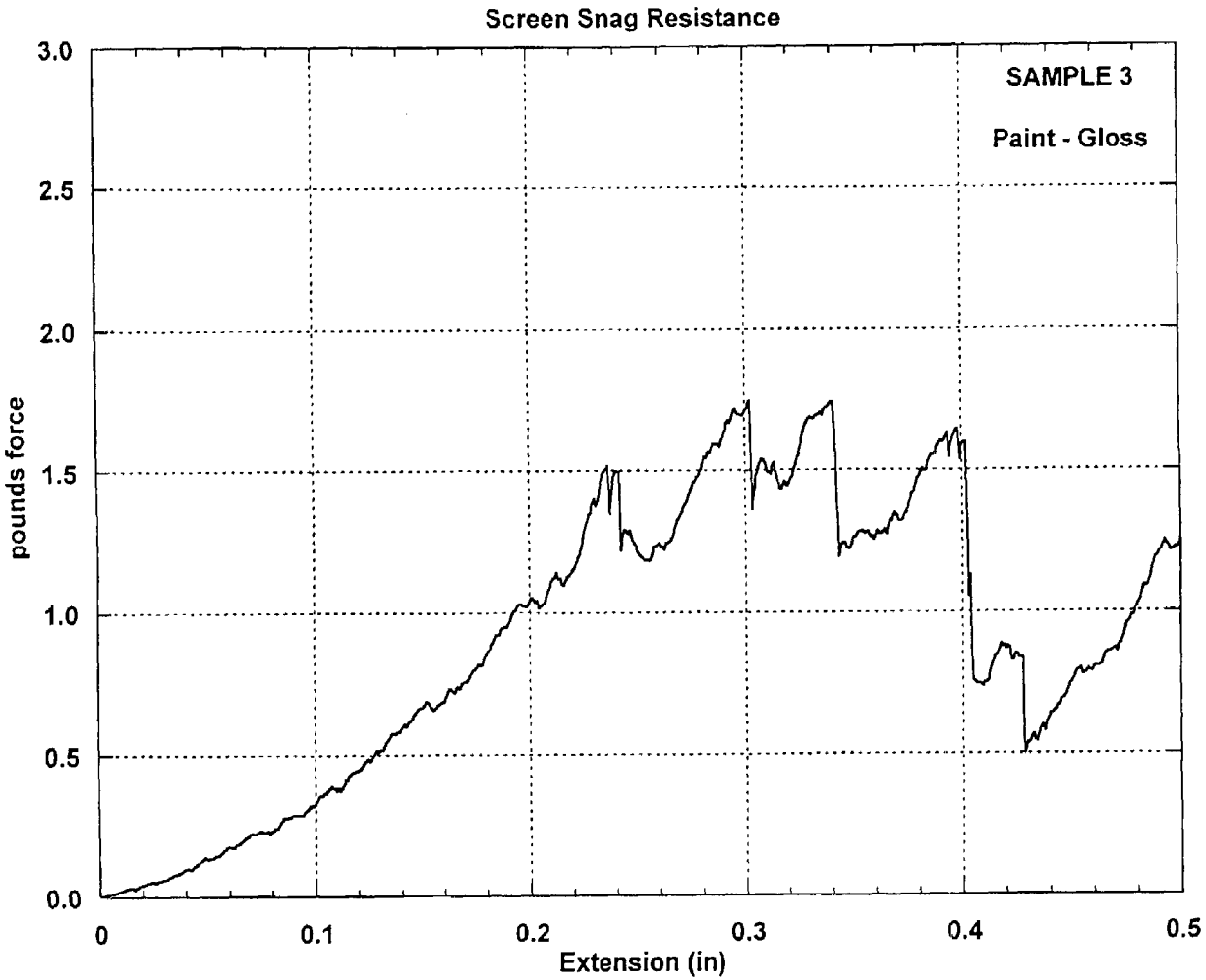

Conversely, FIG. 20 shows a screen with elements coated and joined at their intersections by paint after undergoing the snag resistance test. Unlike the unbonded elements shown in FIG. 19, the painted elements appear to have broken at several locations rather than merely sliding together. FIG. 20 is an example of the element breakage and joint breakage failure mode discussed above. The failure mode shown in FIG. 20 is preferred over the failure mode shown in FIG. 19 because less surface area is disturbed on the screen, creating a more desirable appearance, and a less visible screening, after a snag. The element breakage mode is preferred over the element breakage and joint breakage failure mode because even less surface area is disturbed on the screening.

To achieve an element breakage mode, the joint strength needs to be sufficient to cause the elements to give way before the joints when a snagging force is applied to the screening. On the other hand, it may be desirable in some situations to select element and joint strength so that joint breakage occurs before element breakage, resulting in a more resilient screen. When a force is applied to this type of screening, the element stays intact while the bonds break or slip. The force on the element is then distributed to the other adjacent bonds.

FIGS. 21–25 illustrate the screen snag resistance of Samples 1–3 and 5–6 in terms of pounds of force versus displacement of the snag mandrill 1706. Samples 5 and 6, shown on FIGS. 21 and 22, respectively, show a relatively smooth curve compared to Samples 1–3, shown on FIGS. 23–25, respectively. A smooth curve indicates that the joints between elements are very weak or not bonded. Sample 4 would likely have results similar to Sample 6 in FIG. 22, as the ink coating does not form significant bonds. The joints on Samples 1–3 are much stronger than the joints on Samples 5 and 6. Accordingly, the graph lines on FIGS. 23–25 for Samples 1–3 have several jagged edges. Each sharp drop in the graph corresponds to an element break or a bond break. Sample 2 was able to withstand the largest amount of force of all the samples before an element or bond break.

Size and Spacing of Exemplary Screen Elements

In FIG. 2, a width or diameter W of the screen elements 70 is illustrated. The width W may be less than about 0.007 inch or 0.0035 inch to fall beneath the visual acuity of a normal viewer at either 24 inches or 12 inches, respectively. The smaller the screen element that meets strength requirements, the less visible will be the insect screening. In another embodiment, W is about 0.001 inch (0.025 mm) to about 0.0015 inch (0.04 mm), or about 0.0012 inch. Stainless steel wire, for example, can be provided in this size range and be sufficiently strong for use in insect screening. Each screen element 70 has a length to span the distance between opposed frame members 50, 60 (FIG. 1).

The plurality of screen elements 70 includes a plurality of horizontal screen elements 80 and a plurality of vertical screen elements 90. The horizontal screen elements 80 are spaced apart from each other a distance $D_V$ and the vertical screen elements 90 are spaced apart from each other a distance $D_H$. The spacing depends on the types of insects the user wishes to exclude. Opening sizes are chosen to exclude the types of insects that the screening is designed to keep out. Preferably, the largest values for $D_H$ and $D_V$ are selected that still exclude the targeted insects, so that transmittance is maximized and reflection is minimized.

A screen mesh that excludes most insects is typically constructed with a $D_V$ and $D_H$ of about 0.040 inch (1 mm) or 0.050 inch (1.3 mm). For a screen mesh for excluding smaller insects, like gnats or no-see-ums, a smaller mesh opening is necessary, such as a square opening with a $D_H$ and $D_V$ of about 0.037 or 0.04 inch (1 mm).

In embodiments of the present invention, $D_H$ and $D_V$ may be less than about 0.060 inch (1.5 mm), less than about 0.050 inch (1.25 mm), less than about 0.040 inch (1.0 mm), or less than about 0.030 inch (0.75 mm). $D_V$ and $D_H$ may be equal to form a square opening, or they may differ so that the mesh opening is rectangular. For example, $D_V$ may be about 0.050 inch (1.25 mm) while $D_H$ is about 0.040 (1 mm). All other permutations of the above mentioned dimensions for $D_H$ and $D_V$ are also contemplated. Typically, the vertical and horizontal screen elements are positioned to be perpendicular to each other and aligned with the respective frame members.

Table 3 below lists experimentally measured screen element dimensions for Samples 1–3 and 6. The percent black area is the percentage of the screening that is occupied by the screen elements. The percent open area and the black area add to 100 for a specific screening.

The experimental measurements of Samples 1–3 and 6 in Table 3 were measured by backlighting a sample of each screening and taking a digital photograph. The percent of black area on the photo image was then measured using image analysis software. Knowing the number of elements that were present in each image and the dimensions of the sample, the average coated element thickness was calculated for column 3. For each of Samples 1–6, the underlying uncoated element has a diameter of 0.0012 inch, so this amount was subtracted from the coated element diameter of column 3 to arrive at the average coating thickness of columns 4 and 5.

The PVD CrC coating of Sample 5 and the ink coating of Sample 4 are too thin to be reliably measured by this experimental technique. Based on the deposition technique, the coating of Sample 5 is estimated to be about 0.02 mils (0.5 μm). Because this coating and the ink coating are extremely thin, the percent black area for Samples 4 and 5 are roughly equivalent to the uncoated Sample 6.

The plurality of horizontal and vertical screen elements 80, 90 can be constructed and arranged to form a mesh where a horizontal screen element intersects a vertical screen element perpendicularly. The intersecting horizontal and vertical screen elements 80, 90 may be woven together. Optionally, the intersecting horizontal and vertical screen elements 80, 90 are bonded together at their intersections, as described in more detail below with respect to coating alternatives.

Materials for the Screen Mesh

In order to provide a material for the screening 30 that will withstand the handling that is associated with screen use, several factors are important, such as the screen element diameter and the ultimate tensile strength of the material. In addition, other factors are considered in selecting a material, such as the coefficient of thermal expansion, the brittleness, and the plasticity of a material. The coefficient of thermal expansion is significant because expansion or contraction of the screen elements due to temperature changes may alter the normal alignment of the horizontal and vertical screen elements, thereby leading to visible distortion of the screening.

In one embodiment, materials from the categories of glass fibers, metals or polymers meet the requirements for screen element strength at the desired diameters, such as steel, stainless steel, aluminum, aluminum alloy, polyethylene, ultra high molecular weight polyethylene, polyester, modified nylon, polyamide, polyaramid, and aramid. One mate-

TABLE 3

| | Dimension Data for Examples | | | | | |
|---|---|---|---|---|---|---|
| Screen Sample | Experimentally Measured Percent Black Area | Percent Open Area | Avg. Element Diameter (mm) +/− 0.002 | Avg. Element Diameter (mils) +/− 0.08 | Avg. Coating Thickness (mm) +/− 0.001 | Avg. Coating Thickness (mils) +/− 0.1 |
| 1 Black Zn | 17.0% | 83% | 0.039 | 1.5 | 0.004 | 0.15 |
| 2 Flat Paint | 19.6% | 80.4% | 0.045 | 1.8 | 0.007 | 0.28 |
| 3 Glossy Paint | 18.4% | 81.6% | 0.042 | 1.7 | 0.006 | 0.24 |
| 6 Stainless Steel Base | 14.1% | 85.9% | 0.033 | 1.3 | — | — |

rial that is particularly suited for the screen elements is stainless steel. The high tensile strength of about 162 Ksi and low coefficient of thermal expansion of about $11\times10^{-6}K^{-1}$ for stainless steel are desirable.

Coating or Finish Alternatives

The surface 100 of the screen elements 70 is a dark, non-reflective, and preferably dull or matte finish. A dark non-reflective, dull or matte finish is defined herein to mean a finish that absorbs a sufficient amount of light such that the screen mesh 30 appears less obtrusive than a screen mesh 30 without such finish. The dark non-reflective or matte finish may be any color that absorbs a substantial amount of light, such as, for example, a black color. The dark non-reflective or matte finish can be applied to the screen element surface 100 by any means available such as, for example, physical vapor deposition, electroplating, anodizing, liquid coating, ion deposition, plasma deposition, vapor deposition, and the like. Liquid coating may be, for example, paint, ink, and the like.

For example, a PVD chromium carbide coating or black zinc coating may be applied to the screen elements in one embodiment. The black zinc coating is prefered to the CrC coating because it is rougher, more matte, and less shiny. Alternatively, glossy or flat black paint or black ink may be applied to the screen elements. The flat paint coating is preferred to the glossy paint coating because it is less reflective. Other carbides can also be used to provide a dark finish, such as titanium aluminum carbide or cobalt carbide.

The use of a coating on the screen elements may provide the additional advantage of forming a bond at the intersections of the screen elements. A coating of paint provides some degree of adhesion of the elements at the intersections. Some coatings such as black zinc create bonds at the intersections of the elements. The coating thickness and overall element diameter for Samples 1–3 and 5–6 are listed in Table 3 above.

The improved screening materials of the invention typically comprise a mesh of elements in a screening material. The elements comprise long fibers having a thin coating disposed uniformly around the fiber. The coating comprises the layer that is about 0.10 to 0.30 mils (0.004 to 0.007 mm), preferably about 0.15 mils (0.004 mm). Virtually any material can be used in the coating of the invention that is stable to the influence of outdoor light, weather and the mechanical shocks obtained through coating manufacture, screen manufacture, window assembly, storage, distribution and installation. Such coatings typically have preferred formation technologies. The coatings of this invention, however, can be made using aqueous or solvent based electroplating, chemical vapor deposition techniques and the application of aqueous or solvent based coating compositions having the right proportions of materials that form the thin durable coatings of the invention. Both organic and inorganic coatings can be used. Examples of organic coatings include finely divided carbon, pigmented polymeric materials derived from aqueous or solvent based paints or coating compositions, chemical vapor deposited organic coatings and similar materials. Inorganic coating compositions can include metallic coatings comprising metals such as aluminum, vanadium, chromium, manganese, iron, nickel, copper, zinc, silver, tin, antimony, titanium, platinum, gold, lead and others. Such metallic coatings can be two or more layers covering the element and can include metal oxide materials, metal carbide materials, metal sulfide materials and other similar metal compounds that can form stable, hard coating layers.

Chemical vapor deposition techniques occur by placing the screening or element substrate in an evacuated chamber or at atmosphere and exposing the substrate to a source of chemical vapor that is typically generated by heating an organic or inorganic substance causing a substantial quantity of chemical vapor to fill the treatment chamber. Since the element or screening provides a low energy location for the chemical vapor, the chemical vapor tends to coat any uncoated surface due to the interaction between the element and the coating material formed within the chamber.

In electroplating techniques, the element or screening is typically placed in an aqueous or solvent based plating bath along with an anode structure and a current is placed through the bath so that the screen acts as the cathode. Typically, coating materials are reduced at the cathode and that electrochemical reduction reaction causes the formation of coatings on the substrate material.

Applications for the Insect Screen

The screening 30 can be used with or without a frame 20 in certain applications, such as in a screen porch or pool enclosure. The insect screen 10 can be used in conjunction with a fenestration unit 110, such as a window or door. The insect screen 10 may be used in any arrangement of components constructed and arranged to interact with an opening in a surface such as, for example, a building wall, roof, or a vehicle wall such as a recreational vehicle wall, and the like. The surface may be an interior or exterior surface. The fenestration unit 110 may be a window (i.e. an opening in a wall or building for admission of light and air that may be closed by casements or sashes containing transparent, translucent or opaque material and may be capable of being opened or closed), such as, for example, a picture window, a bay window, a double-hung window, a skylight, casement window, awning window, gliding window and the like. The fenestration unit 110 may be a doorway or door (i.e. a swinging or sliding barrier by which an entry may be closed and opened), such as, for example, an entry door, a patio door, a French door, a side door, a back door, a storm door, a garage door, a sliding door, and the like.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An assembly comprising:

a fenestration unit that permits ventilation therethrough; and, an insect screen in the fenestration unit;

the insect screen including a frame and insect screening mounted in the frame;

the insect screening having elements defining openings with a first dimension and a second dimension;

the first dimension or the second dimension being 0.06 inch or less;

the elements having a diameter of 0.007 inch or less; and the insect screening having a reflectance of light of 0.04 or less.

2. The assembly of claim 1 wherein:

the first dimension or the second dimension being 0.05 inch or less;

the elements having a diameter of 0.007 inch or less; and the insect screening having a reflectance of light of 0.04 or less.

3. The assembly of claim 1 wherein:
the first dimension or the second dimension being 0.04 inch or less;
the elements having a diameter of 0.007 inch or less; and
the insect screening having a reflectance of light of 0.04 or less.

4. The assembly of claim 1 wherein:
the first dimension or the second dimension being 0.06 inch or less;
the elements having a diameter less than 0.006 inch; and
the insect screening having a reflectance of light of 0.04 or less.

5. The assembly of claim 1 wherein:
the first dimension or the second dimension being 0.06 inch or less;
the elements having a diameter of 0.005 inch or less; and
the insect screening having a reflectance of light of 0.04 or less.

6. The assembly of claim 1 wherein:
the first dimension or the second dimension being 0.06 inch or less;
the elements having a diameter of 0.007 inch or less; and
the insect screening having a reflectance of light of 0.03 or less.

7. The assembly of claim 1 wherein:
the first dimension or the second dimension being 0.06 inch or less;
the elements having a diameter of 0.007 inch or less; and
the insect screening having a reflectance of light of 0.02 or less.

8. The assembly of claim 1 wherein:
the first dimension or the second dimension being 0.05 inch or less;
the elements having a diameter of 0.007 inch or less; and
the insect screening having a reflectance of light of 0.03 or less.

9. The assembly of claim 1 wherein:
the first dimension or the second dimension being 0.05 inch or less;
the elements having a diameter of 0.007 inch or less; and
the insect screening having a reflectance of light of 0.02 or less.

10. The assembly of claim 1 wherein:
the first dimension or the second dimension being 0.04 inch or less;
the elements having a diameter of 0.007 inch or less; and
the insect screening having a reflectance of light of 0.03 or less.

11. The assembly of claim 1 wherein:
the first dimension or the second dimension being 0.04 inch or less;
the elements having a diameter of 0.007 inch or less; and
the insect screening having a reflectance of light of 0.02 or less.

12. The assembly of claim 1 wherein:
the first dimension or the second dimension being 0.05 inch or less;
the elements having a diameter less than 0.006 inch; and
the insect screening having a reflectance of light of 0.03 or less.

13. The assembly of claim 1 wherein:
the first dimension or the second dimension being 0.05 inch or less;
the elements having a diameter less than 0.006 inch; and
the insect screening having a reflectance of light of 0.04 or less.

14. The assembly of claim 1 wherein:
the first dimension or the second dimension being 0.05 inch or less;
the elements having a diameter less than 0.006 inch; and
the insect screening having a reflectance of light of 0.02 or less.

15. The assembly of claim 1 wherein:
the first dimension or the second dimension being 0.06 inch or less;
the elements having a diameter less than 0.006 inch; and
the insect screening having a reflectance of light of 0.03 or less.

16. The assembly of claim 1 wherein:
the first dimension or the second dimension being 0.06 inch or less;
the elements having a diameter less than 0.006 inch; and
the insect screening having a reflectance of light of 0.02 or less.

17. The assembly of claim 1 wherein:
the first dimension or the second dimension being 0.06 inch or less;
the elements having a diameter of 0.005 inch or less; and
the insect screening having a reflectance of light of 0.03 or less.

18. The assembly of claim 1 wherein:
the first dimension or the second dimension being 0.06 inch or less;
the elements having a diameter of 0.005 inch or less; and
the insect screening having a reflectance of light of 0.02 or less.

19. The assembly of claim 1 wherein:
the first dimension or the second dimension being 0.05 inch or less;
the elements having a diameter of 0.005 inch or less; and
the insect screening having a reflectance of light of 0.04 or less.

20. The assembly of claim 1 wherein:
the first dimension or the second dimension being 0.05 inch or less;
the elements having a diameter of 0.005 inch or less; and
the insect screening having a reflectance of light of 0.03 or less.

21. The assembly of claim 1 wherein:
the first dimension or the second dimension being 0.05 inch or less;
the elements having a diameter of 0.005 inch or less; and
the insect screening having a reflectance of light of 0.02 or less.

22. The assembly of claim 1 wherein:
the first dimension or the second dimension being 0.04 inch or less;
the elements having a diameter less than 0.006 inch; and
the insect screening having a reflectance of light of 0.04 or less.

23. The assembly of claim 1 wherein:
the first dimension or the second dimension being 0.04 inch or less;
the elements having a diameter less than 0.006 inch; and
the insect screening having a reflectance of light of 0.03 or less.

24. The assembly of claim 1 wherein:
the first dimension or the second dimension being 0.04 inch or less;
the elements having a diameter less than 0.006 inch; and
the insect screening having a reflectance of light of 0.02 or less.

25. The assembly of claim 1 wherein:
the first dimension or the second dimension being 0.04 inch or less;
the elements having a diameter of 0.005 inch or less; and
the insect screening having a reflectance of light of 0.04 or less.

26. The assembly of claim 1 wherein:
the first dimension or the second dimension being 0.04 inch or less;
the elements having a diameter of 0.005 inch or less; and
the insect screening having a reflectance of light of 0.03 or less.

27. The assembly of claim 1 wherein:
the first dimension or the second dimension being 0.04 inch or less;
the elements having a diameter of 0.005 inch or less; and
the insect screening having a reflectance of light of 0.02 or less.

28. The assembly of claim 1 wherein the elements are glass fibers, metal, metals, or polymers.

29. The assembly of claim 1, wherein the elements include a coating.

30. An insect screening comprising:
elements defining openings with a first dimension and a second dimension;
the first dimension or the second dimension being 0.06 inch or less;
the elements having a diameter of 0.007 inch or less; and
the insect screening having a reflectance of light of 0.04 or less;
wherein the insect screening is disposed in a fenestration unit, the fenestration unit permitting ventilation therethrough.

31. The insect screening of claim 30 wherein:
the first dimension or the second dimension being 0.05 inch or less;
the elements having a diameter of 0.007 inch or less; and
the insect screening having a reflectance of light of 0.04 or less.

32. The insect screening of claim 30 wherein:
the first dimension or the second dimension being 0.04 inch or less;
the elements having a diameter of 0.007 inch or less; and
the insect screening having a reflectance of light of 0.04 or less.

33. The insect screening of claim 30 wherein:
the first dimension or the second dimension being 0.06 inch or less;
the elements having a diameter less than 0.006 inch; and
the insect screening having a reflectance of light of 0.04 or less.

34. The insect screening of claim 30 wherein:
the first dimension or the second dimension being 0.06 inch or less;
the elements having a diameter of 0.005 inch or less; and
the insect screening having a reflectance of light of 0.04 or less.

35. The insect screening of claim 30 wherein:
the first dimension or the second dimension being 0.06 inch or less;
the elements having a diameter of 0.007 inch or less; and
the insect screening having a reflectance of light of 0.03 or less.

36. The insect screening of claim 30 wherein:
the first dimension or the second dimension being 0.06 inch or less;
the elements having a diameter of 0.007 inch or less; and
the insect screening having a reflectance of light of 0.02 or less.

37. The insect screening of claim 30 wherein:
the first dimension or the second dimension being 0.05 inch or less;
the elements having a diameter of 0.007 inch or less; and
the insect screening having a reflectance of light of 0.03 or less.

38. The insect screening of claim 30 wherein:
the first dimension or the second dimension being 0.05 inch or less;
the elements having a diameter of 0.007 inch or less; and
the insect screening having a reflectance of light of 0.02 or less.

39. The insect screening of claim 30 wherein:
the first dimension or the second dimension being 0.04 inch or less;
the elements having a diameter of 0.007 inch or less; and
the insect screening having a reflectance of light of 0.03 or less.

40. The insect screening of claim 30 wherein:
the first dimension or the second dimension being 0.04 inch or less;
the elements having a diameter of 0.007 inch or less; and
the insect screening having a reflectance of light of 0.02 or less.

41. The insect screening of claim 30 wherein:
the first dimension or the second dimension being 0.05 inch or less;
the elements having a diameter less than 0.006 inch; and
the insect screening having a reflectance of light of 0.03 or less.

42. The insect screening of claim 30 wherein:
the first dimension or the second dimension being 0.05 inch or less;
the elements having a diameter less than 0.006 inch; and
the insect screening having a reflectance of light of 0.04 or less.

43. The insect screening of claim 30 wherein:
the first dimension or the second dimension being 0.05 inch or less;
the elements having a diameter less than 0.006 inch; and
the insect screening having a reflectance of light of 0.02 or less.

44. The insect screening of claim 30 wherein:
the first dimension or the second dimension being 0.06 inch or less;
the elements having a diameter less than 0.006 inch; and
the insect screening having a reflectance of light of 0.03 or less.

45. The insect screening of claim 30 wherein:
the first dimension or the second dimension being 0.06 inch or less;
the elements having a diameter less than 0.006 inch; and
the insect screening having a reflectance of light of 0.02 or less.

46. The insect screening of claim 30 wherein:
the first dimension or the second dimension being 0.06 inch or less;
the elements having a diameter of 0.005 inch or less; and the insect screening having a reflectance of light of 0.03 or less.

47. The insect screening of claim 30 wherein:

the first dimension or the second dimension being 0.06 inch or less;

the elements having a diameter of 0.005 inch or less; and the insect screening having a reflectance of light of 0.02 or less.

48. The insect screening of claim 30 wherein:

the first dimension or the second dimension being 0.05 inch or less;

the elements having a diameter of 0.005 inch or less; and the insect screening having a reflectance of light of 0.04 or less.

49. The insect screening of claim 30 wherein:

the first dimension or the second dimension being 0.05 inch or less;

the elements having a diameter of 0.005 inch or less; and the insect screening having a reflectance of light of 0.03 or less.

50. The insect screening of claim 30 wherein:

the first dimension or the second dimension being 0.05 inch or less;

the elements having a diameter of 0.005 inch or less; and the insect screening having a reflectance of light of 0.02 or less.

51. The insect screening of claim 30 wherein:

the first dimension or the second dimension being 0.04 inch or less;

the elements having a diameter less than 0.006 inch; and the insect screening having a reflectance of light of 0.04 or less.

52. The insect screening of claim 30 wherein:

the first dimension or the second dimension being 0.04 inch or less;

the elements having a diameter less than 0.006 inch; and the insect screening having a reflectance of light of 0.03 or less.

53. The insect screening of claim 30 wherein:

the first dimension or the second dimension being 0.04 inch or less;

the elements having a diameter less than 0.006 inch; and the insect screening having a reflectance of light of 0.02 or less.

54. The insect screening of claim 30 wherein:

the first dimension or the second dimension being 0.04 inch or less;

the elements having a diameter of 0.005 inch or less; and the insect screening having a reflectance of light of 0.04 or less.

55. The insect screening of claim 30 wherein:

the first dimension or the second dimension being 0.04 inch or less;

the elements having a diameter of 0.005 inch or less; and the insect screening having a reflectance of light of 0.03 or less.

56. The insect screening of claim 30 wherein:

the first dimension or the second dimension being 0.04 inch or less;

the elements having a diameter of 0.005 inch or less; and the insect screening having a reflectance of light of 0.02 or less.

57. The insect screening of claim 30 wherein the elements are glass fibers, metal, metals, or polymers.

58. The insect screening of claim 30, wherein the elements include a coating.

59. An insect screening comprising:

elements defining openings with a first dimension and a second dimension;

the first dimension or the second dimension being 0.06 inch or less;

the elements having a diameter of 0.007 inch or less; and the insect screening having a reflectance of light of 0.04 or less;

wherein the insect screening is spanned across an opening of a building structure, the opening permitting ventilation therethrough.

60. The insect screening of claim 59 wherein:

the first dimension or the second dimension being 0.05 inch or less;

the elements having a diameter of 0.007 inch or less; and the insect screening having a reflectance of light of 0.04 or less.

61. The insect screening of claim 59 wherein:

the first dimension or the second dimension being 0.04 inch or less;

the elements having a diameter of 0.007 inch or less; and the insect screening having a reflectance of light of 0.04 or less.

62. The insect screening of claim 59 wherein:

the first dimension or the second dimension being 0.06 inch or less;

the elements having a diameter less than 0.006 inch; and the insect screening having a reflectance of light of 0.04 or less.

63. The insect screening of claim 59 wherein:

the first dimension or the second dimension being 0.06 inch or less;

the elements having a diameter of 0.005 inch or less; and the insect screening having a reflectance of light of 0.04 or less.

64. The insect screening of claim 59 wherein:

the first dimension or the second dimension being 0.06 inch or less;

the elements having a diameter of 0.007 inch or less; and the insect screening having a reflectance of light of 0.03 or less.

65. The insect screening of claim 59 wherein:

the first dimension or the second dimension being 0.06 inch or less;

the elements having a diameter of 0.007 inch or less; and the insect screening having a reflectance of light of 0.02 or less.

66. The insect screening of claim 59 wherein:

the first dimension or the second dimension being 0.05 inch or less;

the elements having a diameter of 0.007 inch or less; and the insect screening having a reflectance of light of 0.03 or less.

67. The insect screening of claim 59 wherein:

the first dimension or the second dimension being 0.05 inch or less;

the elements having a diameter of 0.007 inch or less; and the insect screening having a reflectance of light of 0.02 or less.

68. The insect screening of claim 59 wherein:

the first dimension or the second dimension being 0.04 inch or less;

the elements having a diameter of 0.007 inch or less; and the insect screening having a reflectance of light of 0.03 or less.

69. The insect screening of claim 59 wherein:
the first dimension or the second dimension being 0.04 inch or less;
the elements having a diameter of 0.007 inch or less; and
the insect screening having a reflectance of light of 0.02 or less.

70. The insect screening of claim 59 wherein:
the first dimension or the second dimension being 0.05 inch or less;
the elements having a diameter less than 0.006 inch; and
the insect screening having a reflectance of light of 0.03 or less.

71. The insect screening of claim 59 wherein:
the first dimension or the second dimension being 0.05 inch or less;
the elements having a diameter less than 0.006 inch; and
the insect screening having a reflectance of light of 0.04 or less.

72. The insect screening of claim 59 wherein:
the first dimension or the second dimension being 0.05 inch or less;
the elements having a diameter less than 0.006 inch; and
the insect screening having a reflectance of light of 0.02 or less.

73. The insect screening of claim 59 wherein:
the first dimension or the second dimension being 0.06 inch or less;
the elements having a diameter less than 0.006 inch; and
the insect screening having a reflectance of light of 0.03 or less.

74. The insect screening of claim 59 wherein:
the first dimension or the second dimension being 0.06 inch or less;
the elements having a diameter less than 0.006 inch; and
the insect screening having a reflectance of light of 0.02 or less.

75. The insect screening of claim 59 wherein:
the first dimension or the second dimension being 0.06 inch or less;
the elements having a diameter of 0.005 inch or less; and
the insect screening having a reflectance of light of 0.03 or less.

76. The insect screening of claim 59 wherein:
the first dimension or the second dimension being 0.06 inch or less;
the elements having a diameter of 0.005 inch or less; and
the insect screening having a reflectance of light of 0.02 or less.

77. The insect screening of claim 59 wherein:
the first dimension or the second dimension being 0.05 inch or less;
the elements having a diameter of 0.005 inch or less; and
the insect screening having a reflectance of light of 0.04 or less.

78. The insect screening of claim 59 wherein:
the first dimension or the second dimension being 0.05 inch or less;
the elements having a diameter of 0.005 inch or less; and
the insect screening having a reflectance of light of 0.03 or less.

79. The insect screening of claim 59 wherein:
the first dimension or the second dimension being 0.05 inch or less;
the elements having a diameter of 0.005 inch or less; and
the insect screening having a reflectance of light of 0.02 or less.

80. The insect screening of claim 59 wherein:
the first dimension or the second dimension being 0.04 inch or less;
the elements having a diameter less than 0.006 inch; and
the insect screening having a reflectance of light of 0.04 or less.

81. The insect screening of claim 59 wherein:
the first dimension or the second dimension being 0.04 inch or less;
the elements having a diameter less than 0.006 inch; and
the insect screening having a reflectance of light of 0.03 or less.

82. The insect screening of claim 59 wherein:
the first dimension or the second dimension being 0.04 inch or less;
the elements having a diameter less than 0.006 inch; and
the insect screening having a reflectance of light of 0.02 or less.

83. The insect screening of claim 59 wherein:
the first dimension or the second dimension being 0.04 inch or less;
the elements having a diameter of 0.005 inch or less; and
the insect screening having a reflectance of light of 0.04 or less.

84. The insect screening of claim 59 wherein:
the first dimension or the second dimension being 0.04 inch or less;
the elements having a diameter of 0.005 inch or less; and
the insect screening having a reflectance of light of 0.03 or less.

85. The insect screening of claim 59 wherein:
the first dimension or the second dimension being 0.04 inch or less;
the elements having a diameter of 0.005 inch or less; and
the insect screening having a reflectance of light of 0.02 or less.

86. The insect screening of claim 59 wherein the elements are glass fibers, metal, metals, or polymers.

87. The insect screening of claim 59, wherein the elements include a coating.

* * * * *